US009623674B2

(12) United States Patent
Ihara et al.

(10) Patent No.: US 9,623,674 B2
(45) Date of Patent: Apr. 18, 2017

(54) IMAGE FORMING APPARATUS, RETRANSFER PRINTER, AND IMAGE FORMING METHOD

(71) Applicant: JVC KENWOOD CORPORATION, Yokohama-shi, Kanagawa (JP)

(72) Inventors: Keiji Ihara, Yokohama (JP); Yuji Okada, Yokohama (JP)

(73) Assignee: JVC KENWOOD CORPORATION, Yokohama-Shi, Kanagawa (JP)

( * ) Notice: Subject to any disclaimer, the term of this patent is extended or adjusted under 35 U.S.C. 154(b) by 0 days.

(21) Appl. No.: 15/215,781

(22) Filed: Jul. 21, 2016

(65) Prior Publication Data

US 2016/0325556 A1 Nov. 10, 2016

Related U.S. Application Data

(63) Continuation of application No. PCT/JP2015/068183, filed on Jun. 24, 2015.

(30) Foreign Application Priority Data

Sep. 26, 2014 (JP) ..... 2014-196052
Sep. 17, 2015 (JP) ..... 2015-183854

(51) Int. Cl.
*B41J 2/15* (2006.01)
*B41J 2/325* (2006.01)
*B41J 2/355* (2006.01)

(52) U.S. Cl.
CPC ..... *B41J 2/325* (2013.01); *B41J 2/355* (2013.01)

(58) Field of Classification Search
CPC ... B41J 2/32; B41J 2/325; B41J 3/4075; B41J 15/04; B41J 2202/33; B41J 29/02; B41J 2/22; B41J 2/3351; B41J 2/33525
See application file for complete search history.

(56) References Cited

U.S. PATENT DOCUMENTS 8,040,366 B2 * 10/2011 Yaguchi ..... B41J 2/325 347/212
8,441,509 B2 * 5/2013 Matsuoka ..... B41J 2/325 347/212
8,553,054 B2 * 10/2013 Yasumatsu ..... B41M 5/38264 347/176

FOREIGN PATENT DOCUMENTS

JP 62-23768 A 1/1987
JP 2002-240331 A 8/2002
(Continued)

OTHER PUBLICATIONS

PCT/ISA/237 dated Sep. 8, 2015 issued in corresponding International Application No. PCT/JP2015/068183.

*Primary Examiner* — Lamson Nguyen
(74) *Attorney, Agent, or Firm* — Nath, Goldberg & Meyer; Jerald L. Meyer

(57) ABSTRACT

An image forming apparatus includes a platen roller, an ink ribbon, a transfer target, a thermal head, and a controller. When continuous n-spot transfer regions set on the transfer target are named as first to n-th (n is an integer of 2 or more) transfer regions in a reverse direction to an alignment sequence of first to n-th ink layers, the controller executes transfer operations of transferring inks of first to k-th ($1 \leq k \leq n$) ink layers to the n-spot transfer regions by using first to n-th ink sets from k=1 to k=n. By the transfer operations, a color image to which n-color inks are transferred is formed on the first transfer region.

12 Claims, 23 Drawing Sheets

(56) References Cited

FOREIGN PATENT DOCUMENTS

| | | | |
|---|---|---|---|
| JP | 2004-322404 | A | 11/2004 |
| JP | 4337582 | B2 | 7/2009 |

* cited by examiner

IMAGE FORMING APPARATUS, RETRANSFER PRINTER, AND IMAGE FORMING METHOD

CROSS REFERENCE TO RELATED APPLICATION

This application is a continuation-in-part application of PCT Application No. PCT/JP2015/068183 filed on Jun. 24, 2015, which claims the priority of Japanese Patent Applications No. 2014-196052, filed on Sep. 26, 2014, the entire contents of which are incorporated herein by reference.

This application also claims priority to Japanese Patent Applications No. 2015-183854, filed on Sep. 17, 2015, which claims priority to PCT Application No. PCT/JP2015/068183 filed on Jun. 24, 2015, the entire contents of which are incorporated herein by reference.

BACKGROUND

The present disclosure relates to an image forming apparatus, a retransfer printer, and an image forming method, each of which form a color image by transferring inks of respective colors to a transfer target from an ink ribbon, on which a set of ink layers of plural colors are repeatedly coated in a conveying direction.

An image forming apparatus that is widely used forms a color image by transferring inks of respective colors to the same transfer region of a transfer target from an ink ribbon, on which a set of ink layers of plural colors are repeatedly coated in a conveying direction.

In Japanese Patent No. 4337582 (Patent Document 1), a retransfer-system printing apparatus is described, including this type of image forming apparatus. There are four plural colors of an ink ribbon for use in this printing apparatus: yellow, magenta, cyan, and black. The transfer target is a belt-like intermediate transfer film.

The printing apparatus described in Patent Document 1 attaches a thermal head with pressure onto the ink ribbon, while superimposing the ink ribbon onto the intermediate transfer film and moving the ink ribbon in the conveying direction, and then transfers the inks of the respective colors to the same transfer region (hereinafter, the transfer region is also referred to as a frame) in the intermediate transfer film one color at a time, thereby forming a color image.

The printing apparatus performs respective operations for each of the colors, which are separation of the thermal head, rewinding and cueing for one frame of the intermediate transfer film, and attaching of the thermal head by pressure onto the ink ribbon, in this order.

Hence, the printing apparatus executes four cueing operations (three rewinding operations) for the intermediate transfer film in order to form a color image of one frame, which uses the inks of the four colors.

The printing apparatus described in Patent Document 1 includes a retransfer apparatus, which performs retransfer operations of retransferring the color image, which is formed on the intermediate transfer film to a printing target such as a card, in addition to the image forming apparatus that performs the image forming operations as described above.

SUMMARY

Incidentally, it is desired that the image forming apparatus could form the color image of each frame in as short a time as possible. That is, it is desired that the image forming speed be faster.

Usually, the temperatures of the thermal head and the transfer temperature are raised, whereby it is possible to some extent to accelerate such image formation.

However, if the temperature of the thermal head is raised too much, problems may occur, such as deformation of ink film, or welding of the ink film to the transfer target, which result in quality degradation of the image. Accordingly, there are limitations in the acceleration of the image forming speed, brought about by raising the transfer temperature.

A first aspect of the embodiments provides an image forming apparatus including: an ink ribbon in which a first ink layer coated with a first-color ink to an n-th ink layer coated with an n-th (n is an integer of 2 or more)-color ink are defined as a set of ink layers, and a plurality of the ink sets is repeatedly arrayed and coated along a first conveying direction; a first transfer target in which a plurality of transfer regions are set along a second conveying direction; a platen roller; a thermal head configured to bring the ink ribbon and the first transfer target into pressure contact with the platen roller, and configured to transfer the inks of the ink ribbons to the first transfer target; and a controller configured to, when continuous n-spot transfer regions set on the first transfer target are named as first to n-th transfer regions in a reverse direction to an alignment sequence of the first to n-th ink layers in the ink sets, allow the thermal head to execute, for the n-spot transfer regions, transfer operations of transferring inks of first to k-th ($1 \leq k \leq n$) ink layers to k-th to first transfer regions by using first to n-th ink sets, and configured to control to form a color image, to which n-color inks are transferred on the first transfer region.

A second aspect of the embodiments provides a retransfer printer including: the above-described image forming apparatus; and a retransfer apparatus configured to retransfer a color image formed on the first transfer target to a second transfer target.

A third aspect of the embodiments provides an image forming method including: superimposing an ink ribbon and a transfer target on each other, wherein, in the ink ribbon, a first ink layer coated with a first-color ink to an n-th ink layer coated with an n-th (n is an integer of 2 or more)-color ink are defined as a set of ink layers, and a plurality of the ink sets is repeatedly arrayed and coated along a first conveying direction, and in the transfer target, a plurality of transfer regions are set along a second conveying direction; when continuous n-spot transfer regions set on the transfer target are named as first to n-th transfer regions in a reverse direction to an alignment sequence of the first to n-th ink layers in the ink sets, executing transfer operations of transferring inks of first to k-th ($1 \leq k \leq n$) ink layers to the n-spot transfer regions by using the 1st to n-th ink sets from k=1 to k=n; and forming a color image, to which n-color inks are transferred, on the first transfer region.

Figure 3:
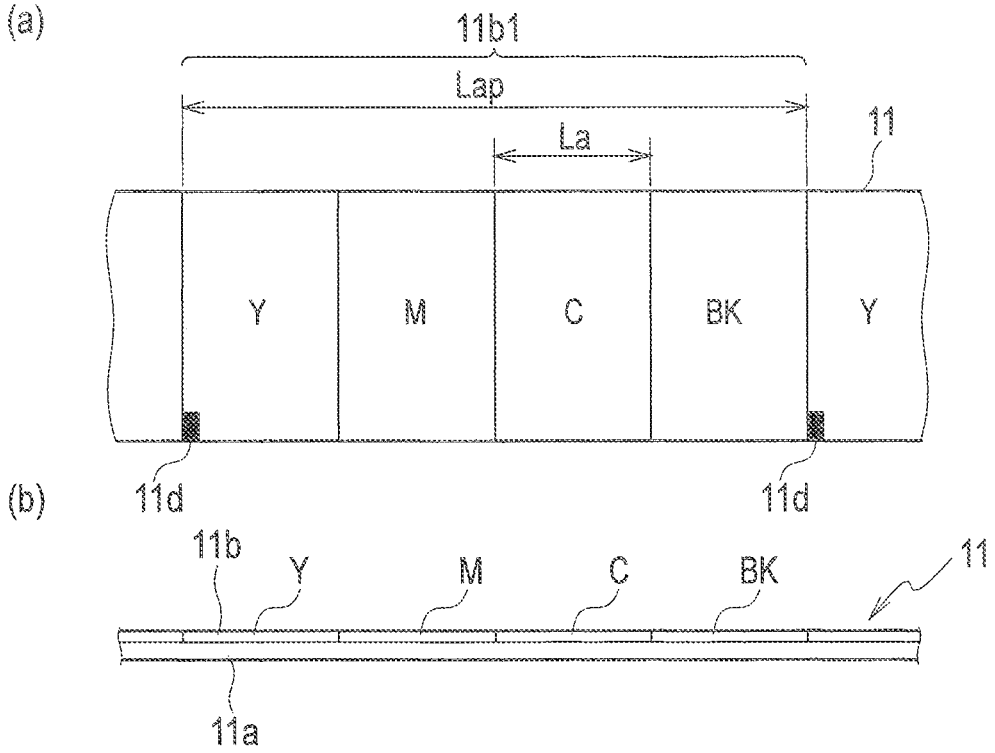

(a) of FIG. 3 is a plan view showing an ink ribbon 11 for use in the image forming apparatus 51, and (b) of FIG. 3 is a side view showing the ink ribbon 11.

Figure 4:
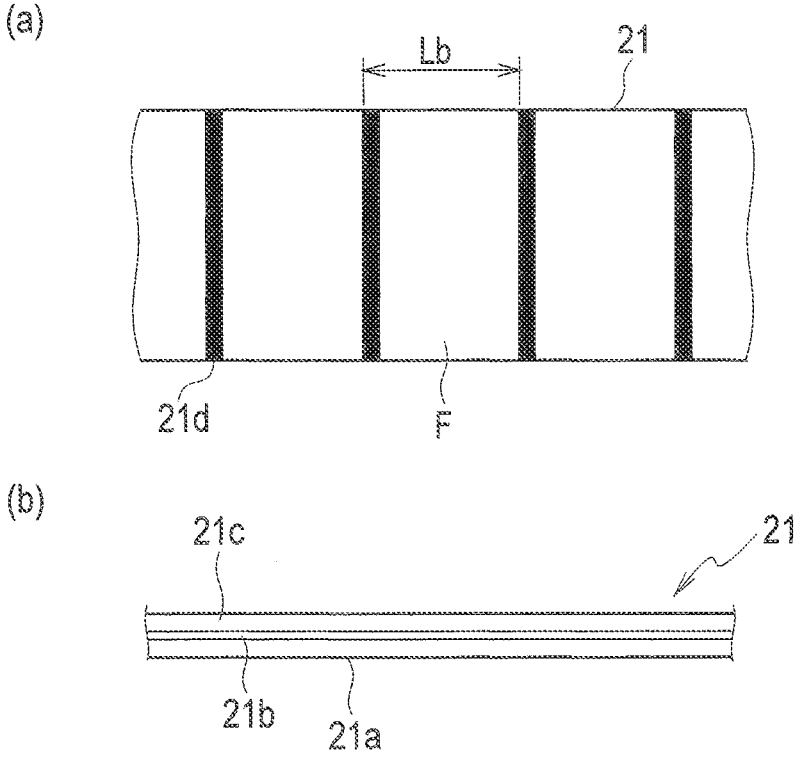

(a) of FIG. 4 is a plan view showing an intermediate transfer film 21 that is an image forming body for use in the image forming apparatus 51, and (b) of FIG. 4 is a side view showing the intermediate transfer film 21.

Figure 5:
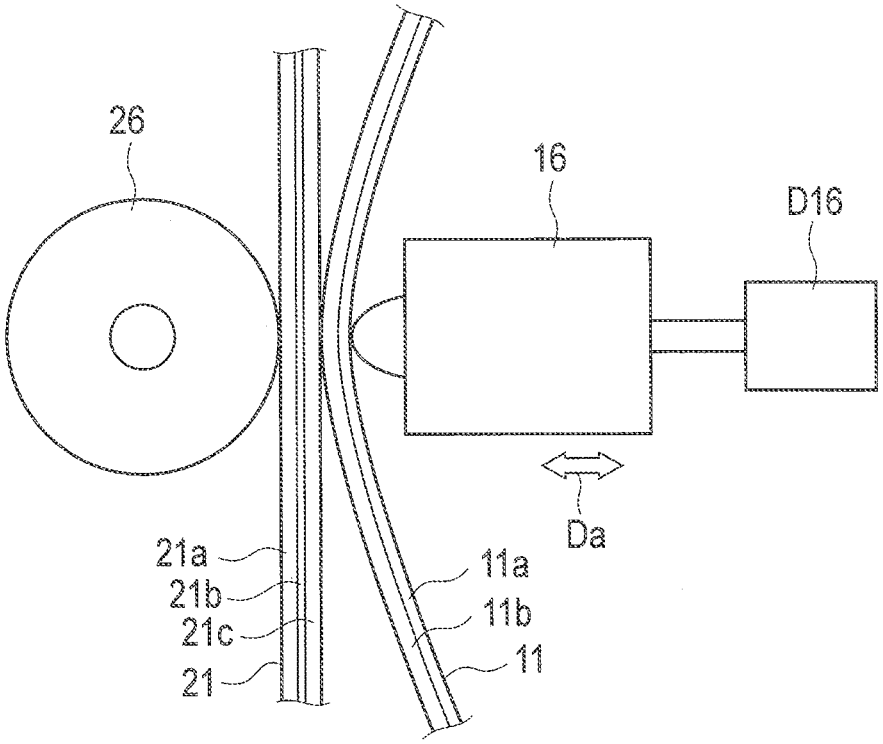

FIG. 5 is a partial schematic view showing a state where a thermal head 16 in the image forming apparatus 51 is placed in a pressure contact position.

Figure 6:
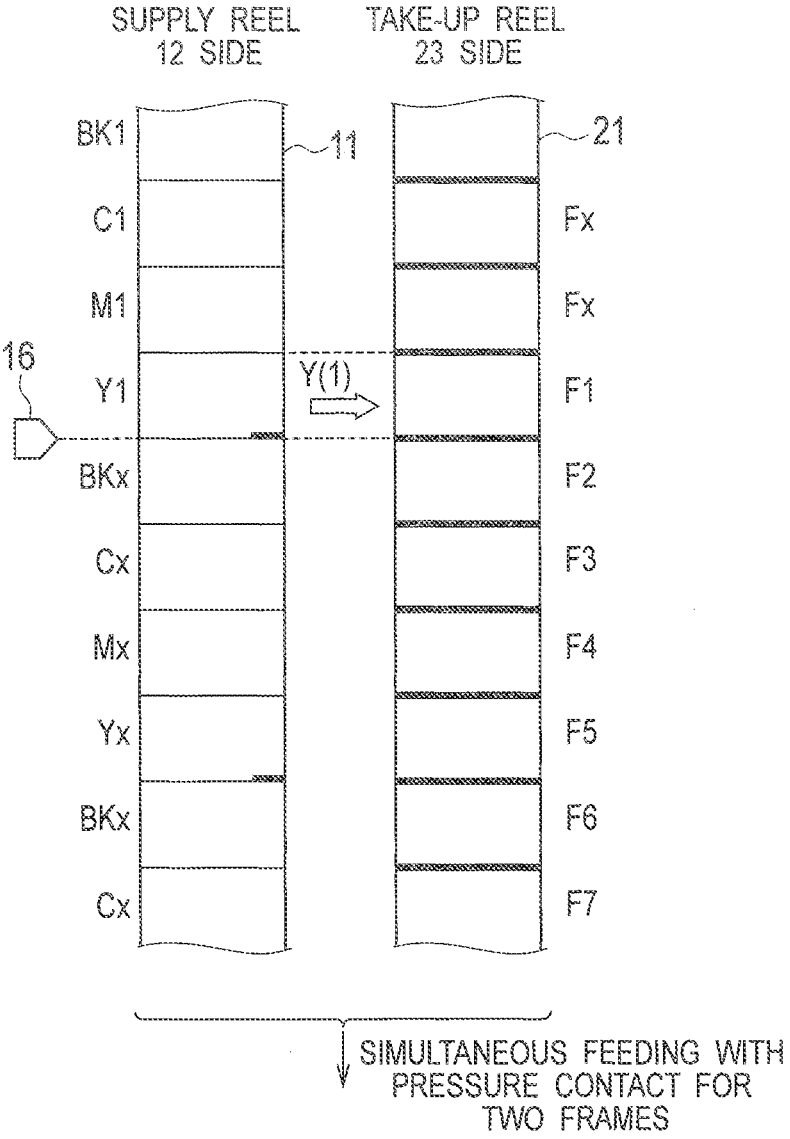

FIG. 6 is a view for describing the first operation of forming the first color image onto the transfer regions of the intermediate transfer film 21.

Figure 7:
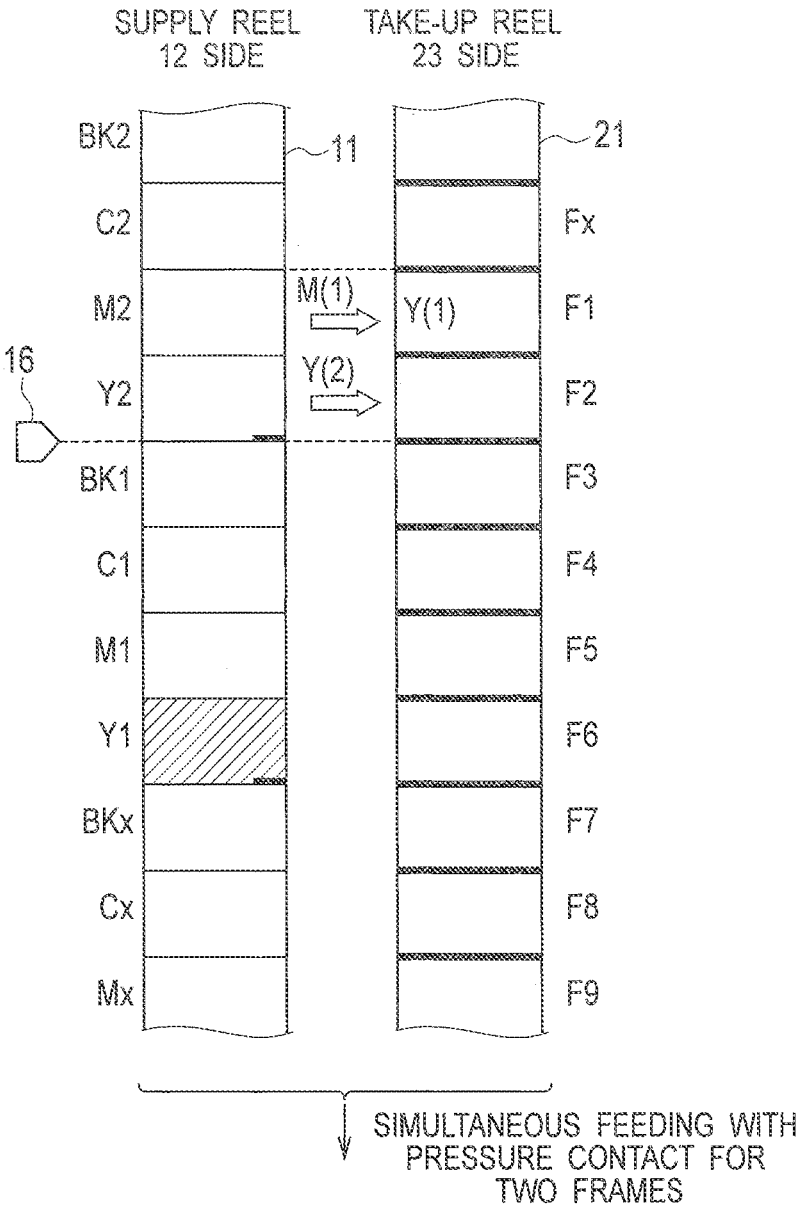

FIG. 7 is a view for describing the second operation of forming the first color image onto the transfer regions of the intermediate transfer film 21.

Figure 8:
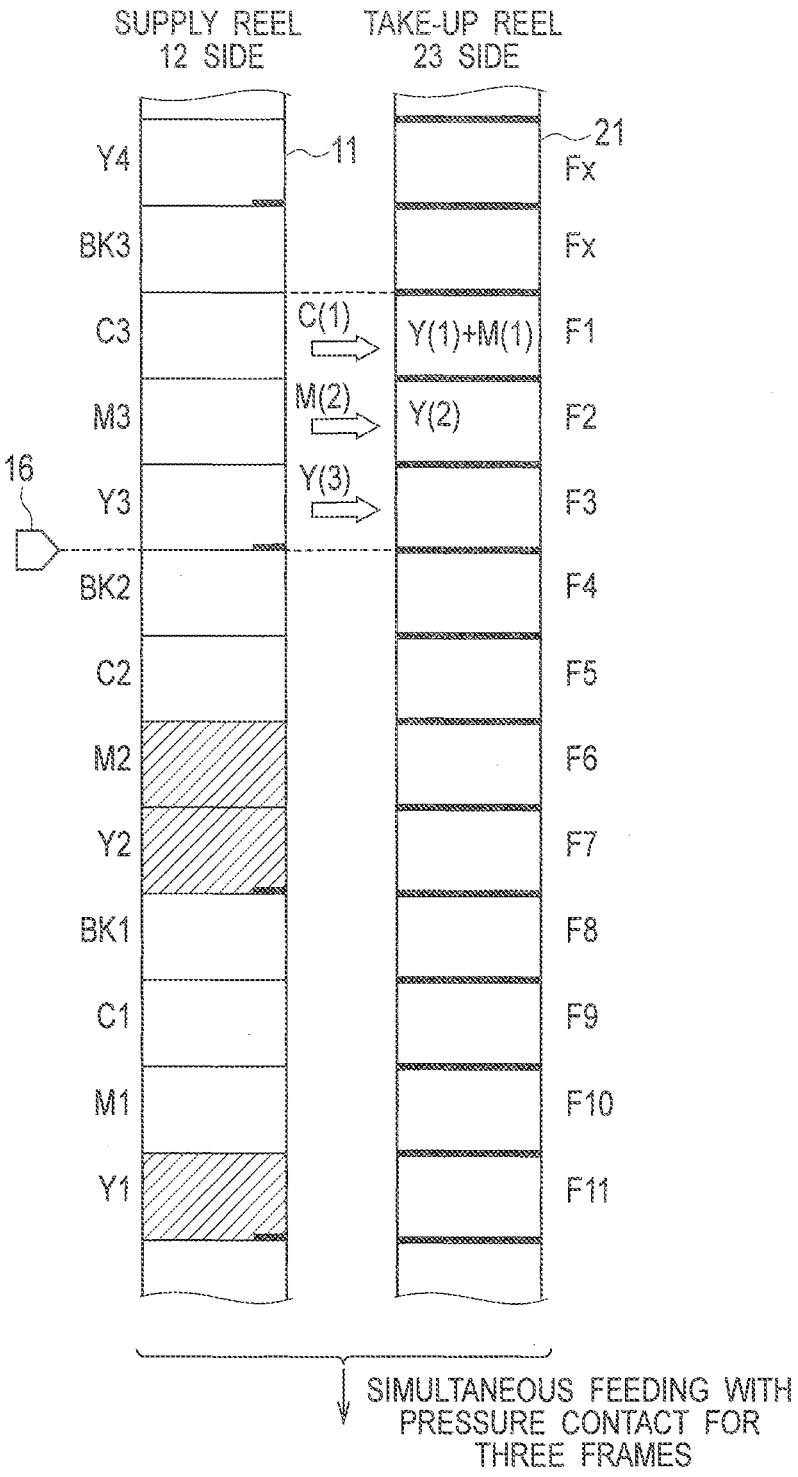

FIG. 8 is a view for describing the third operation of forming the first color image onto the transfer regions of the intermediate transfer film 21.

Figure 9:
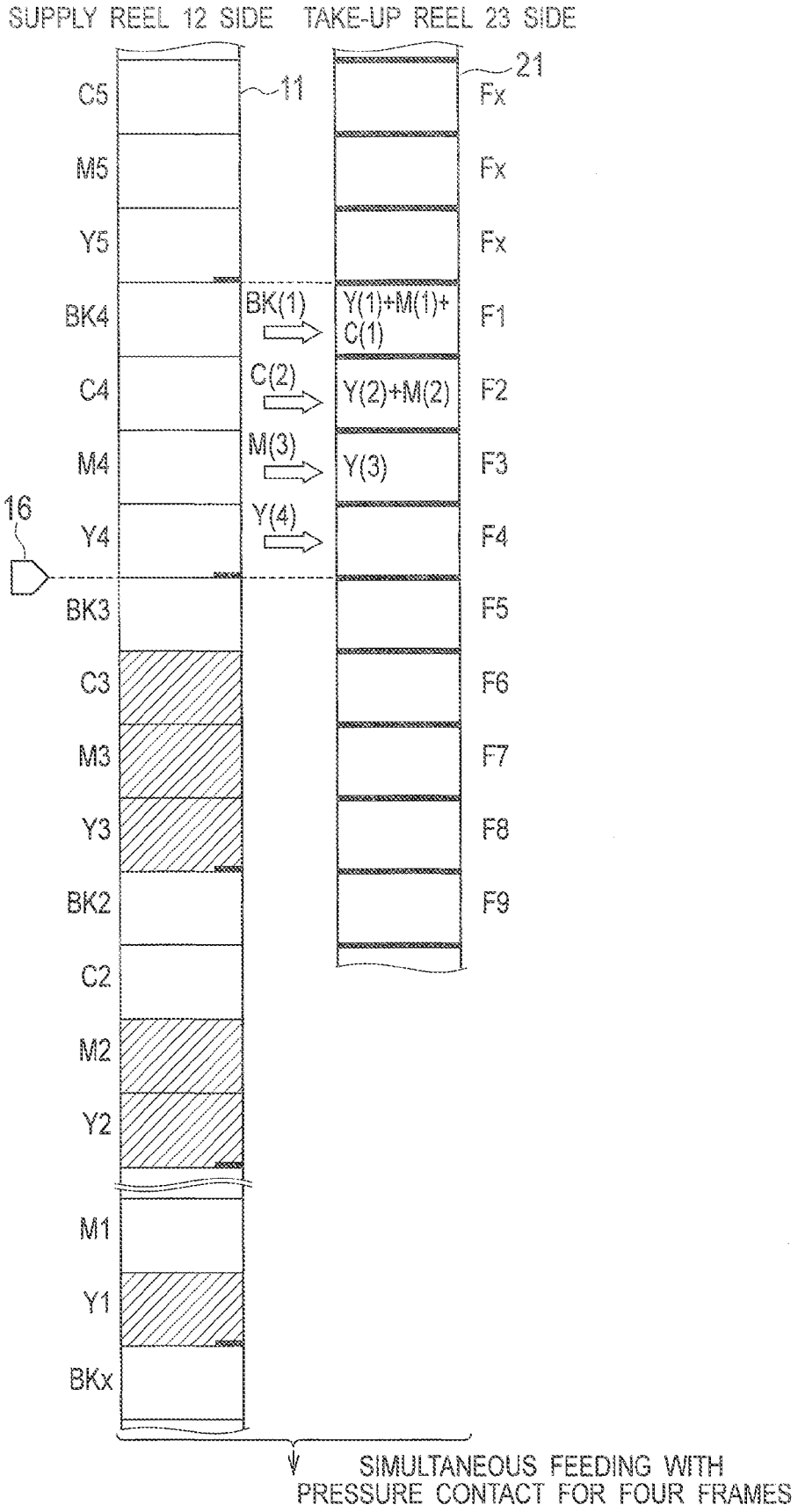

FIG. 9 is a view for describing the fourth operation of forming the first color image onto the transfer regions of the intermediate transfer film 21.

Figure 10:
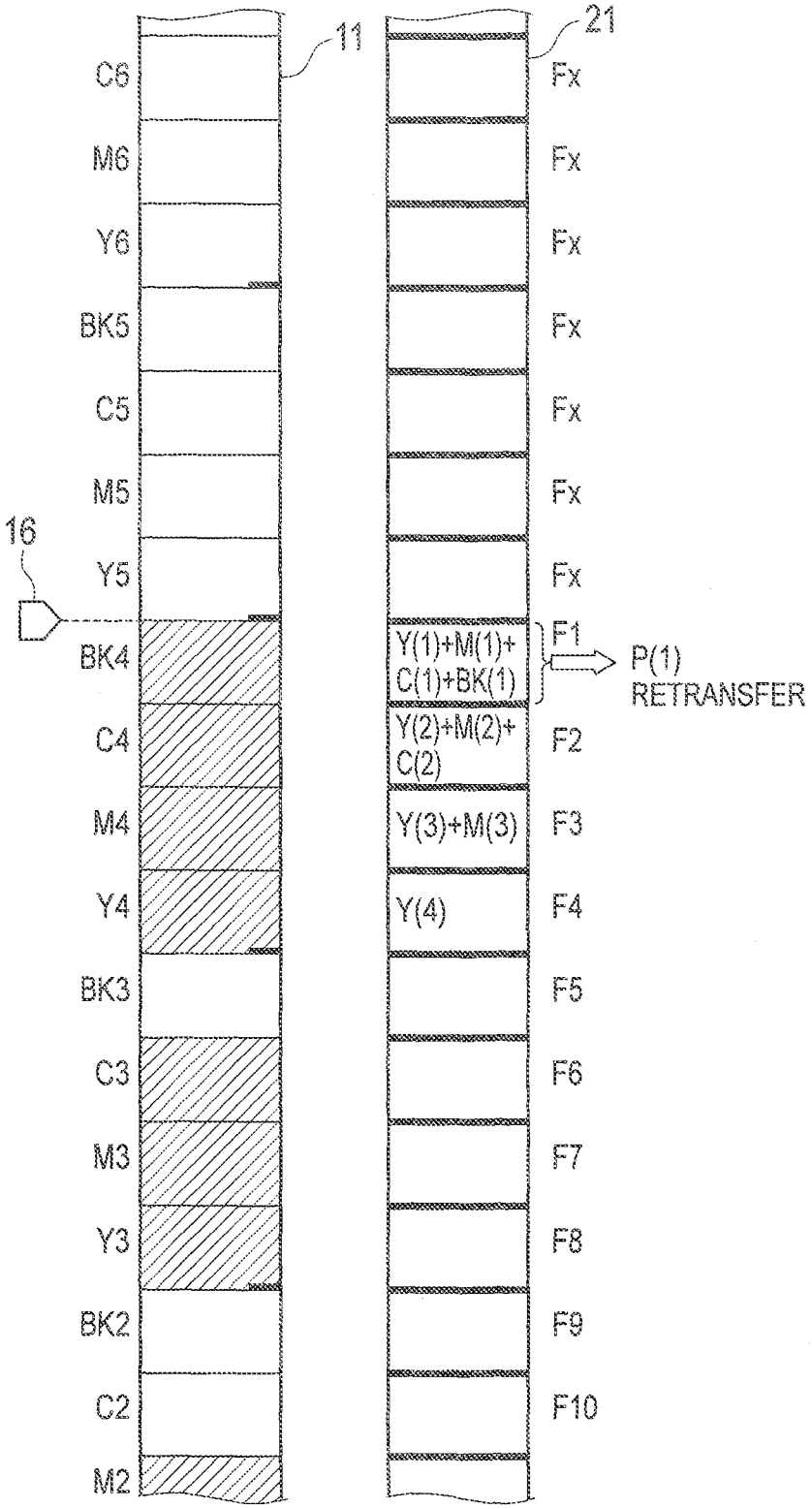

FIG. 10 is a view showing an operation of retransferring the color image, which is formed onto the intermediate transfer film 21 for the first time to another transfer target.

Figure 11:
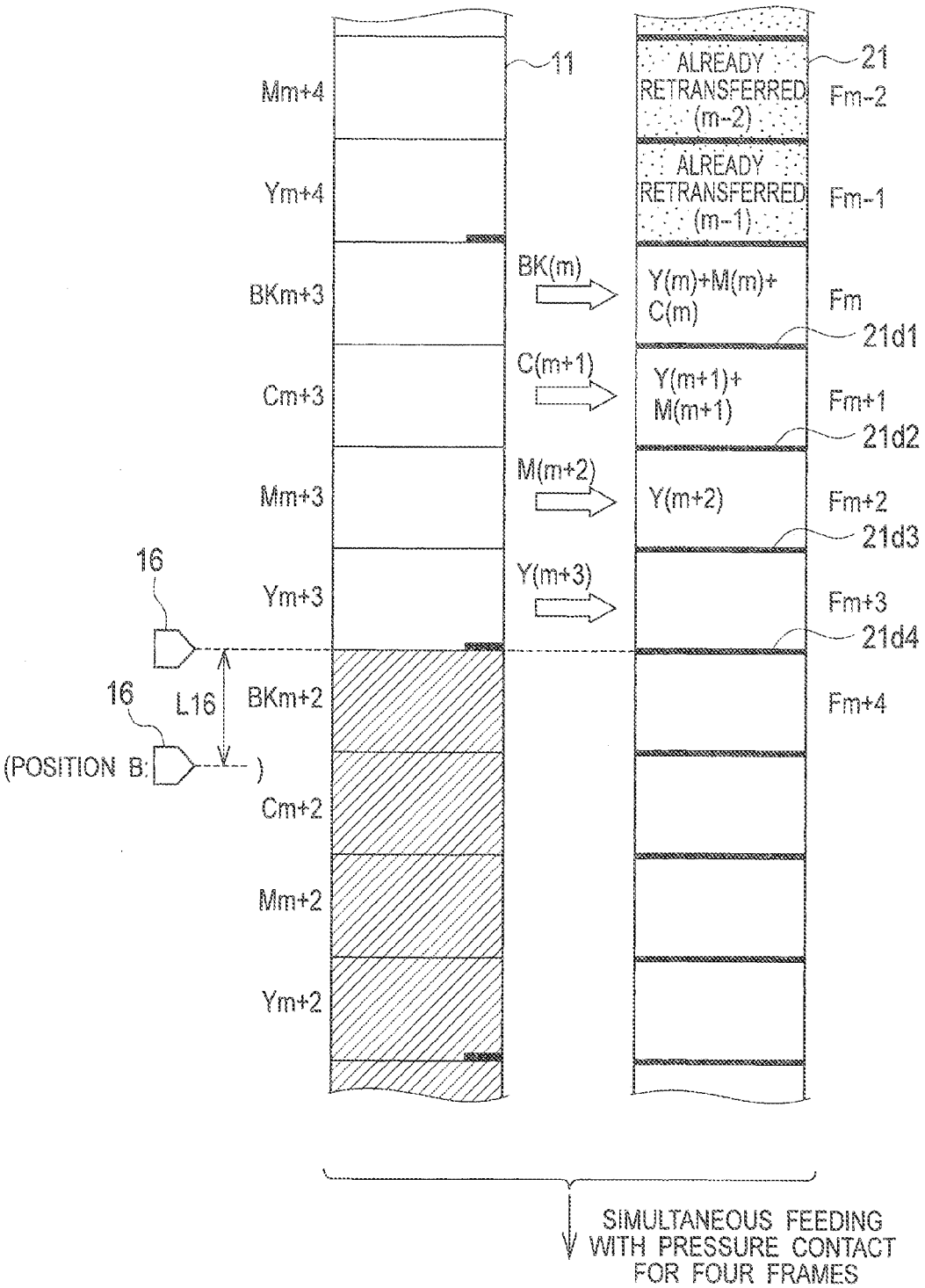

FIG. 11 is the first view for describing a method for forming a color image onto the intermediate transfer film 21 in continuous transfer, according to the embodiment.

Figure 12:
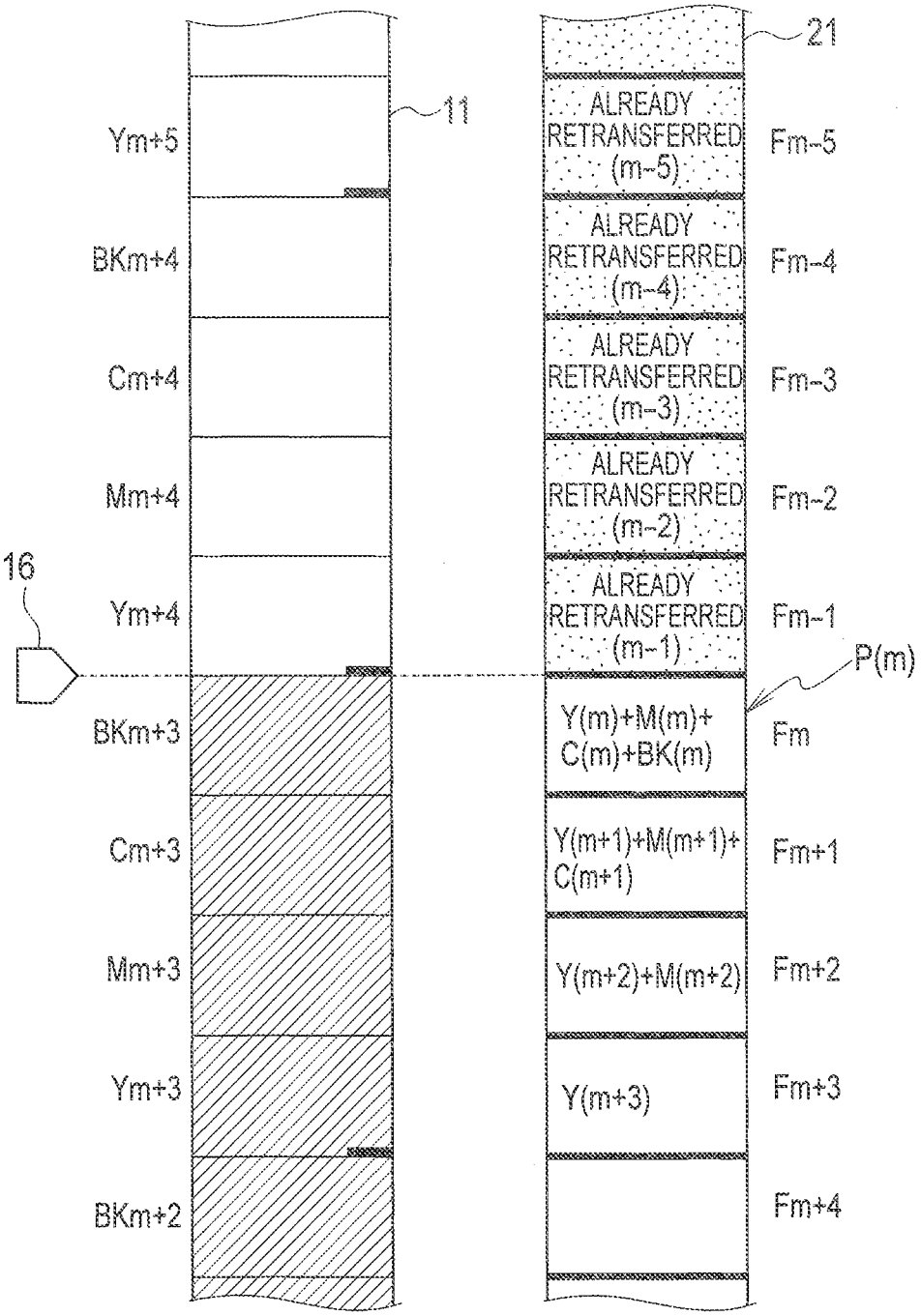

FIG. 12 is the second view for describing the method for forming the image onto the intermediate transfer film 21 in the continuous transfer, according to the embodiment.

Figure 13A:
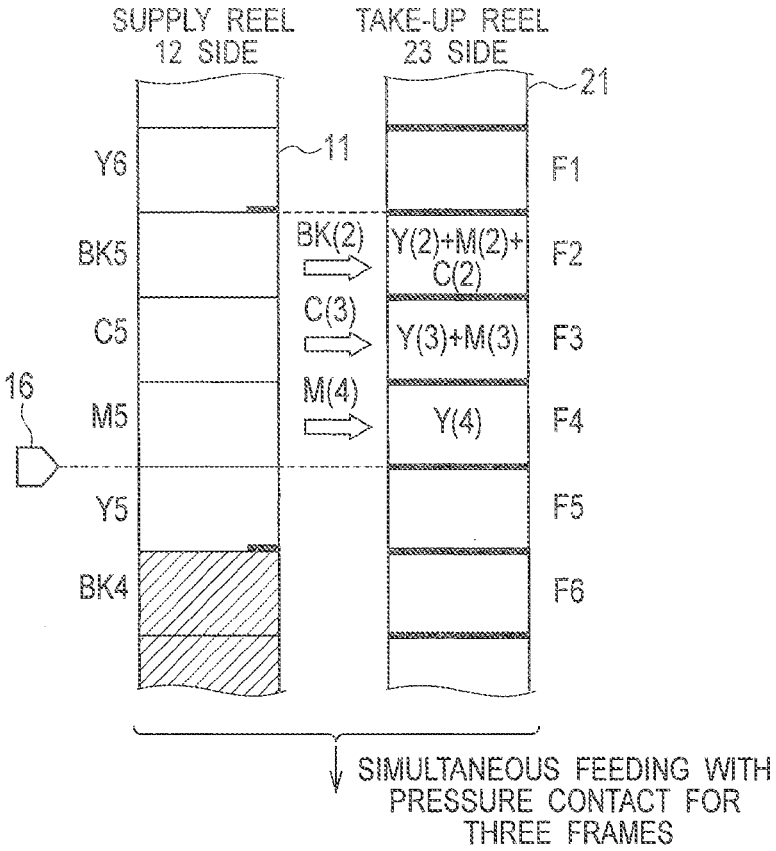

FIG. 13A is a view for describing the first operation of forming a final color image onto the transfer regions of the intermediate transfer film 21.

Figure 13B:
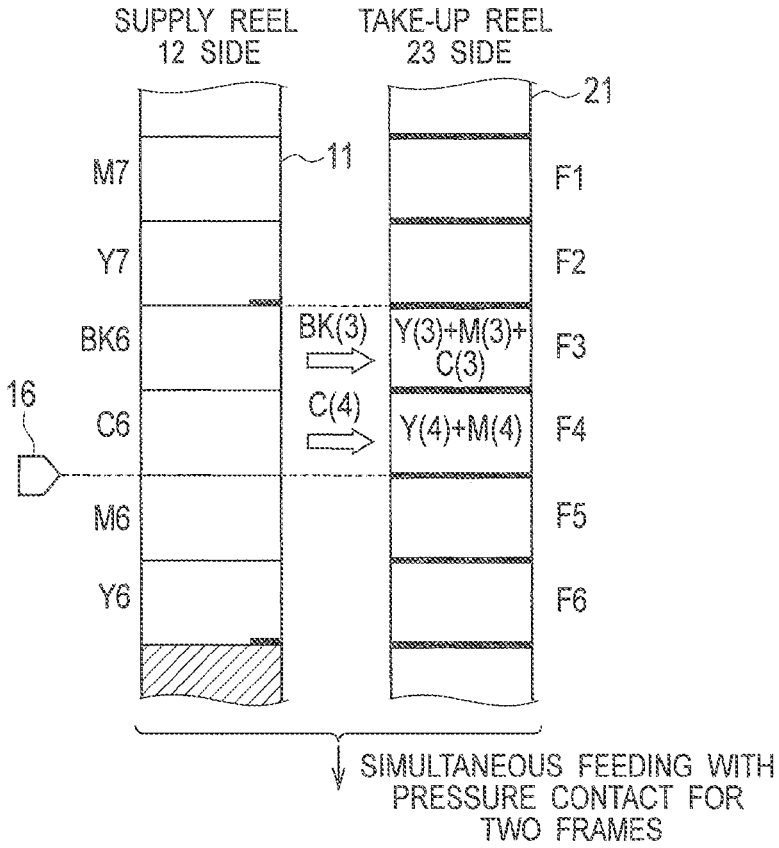

FIG. 13B is a view for describing the second operation of forming the final color image onto the transfer regions of the intermediate transfer film 21.

Figure 13C:
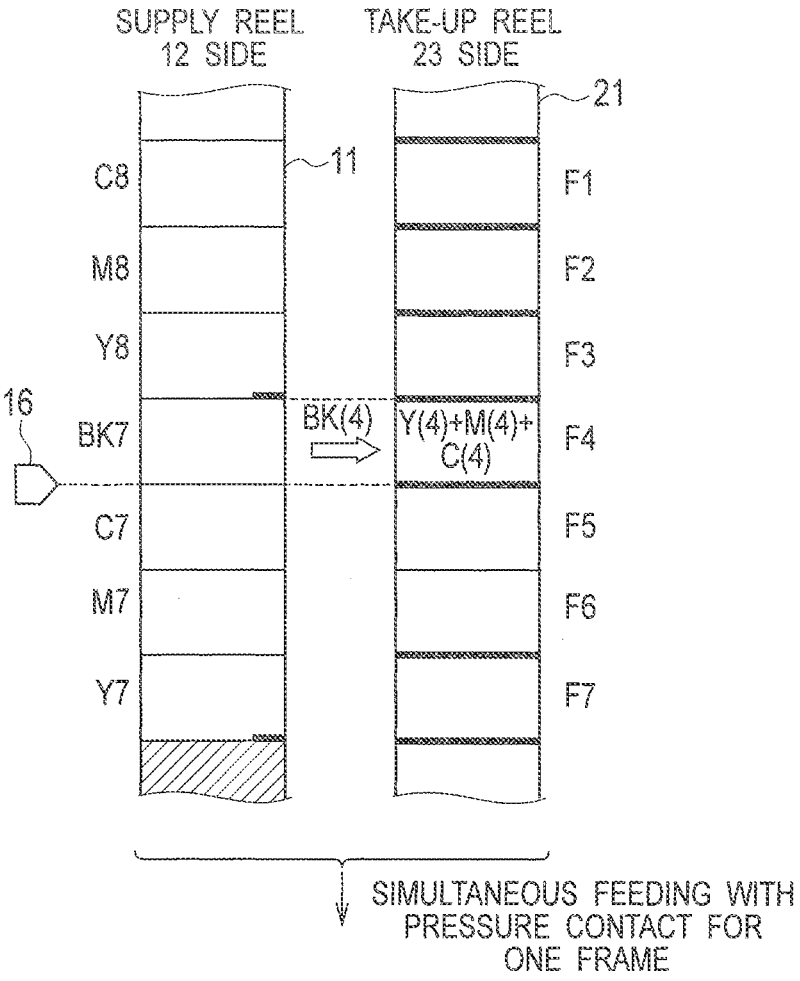

FIG. 13C is a view for describing the third operation of forming the final color image onto the transfer regions of the intermediate transfer film 21.

Figure 13D:
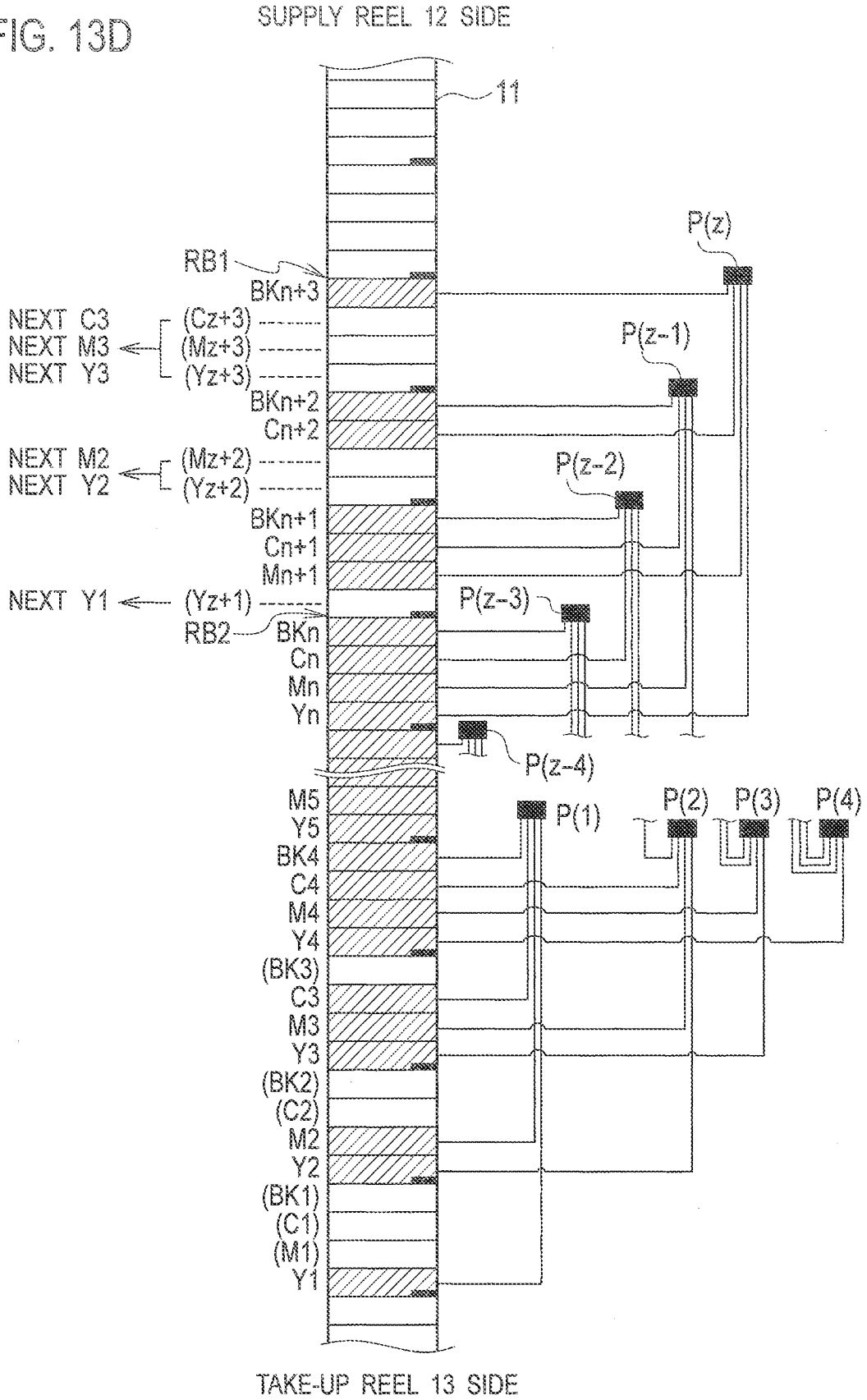

FIG. 13D is a view for describing the state of the ink ribbon 11 and the transfer destinations of the respective inks at the time of forming the final color image onto a transfer region of an arbitrary final set.

Figure 14:
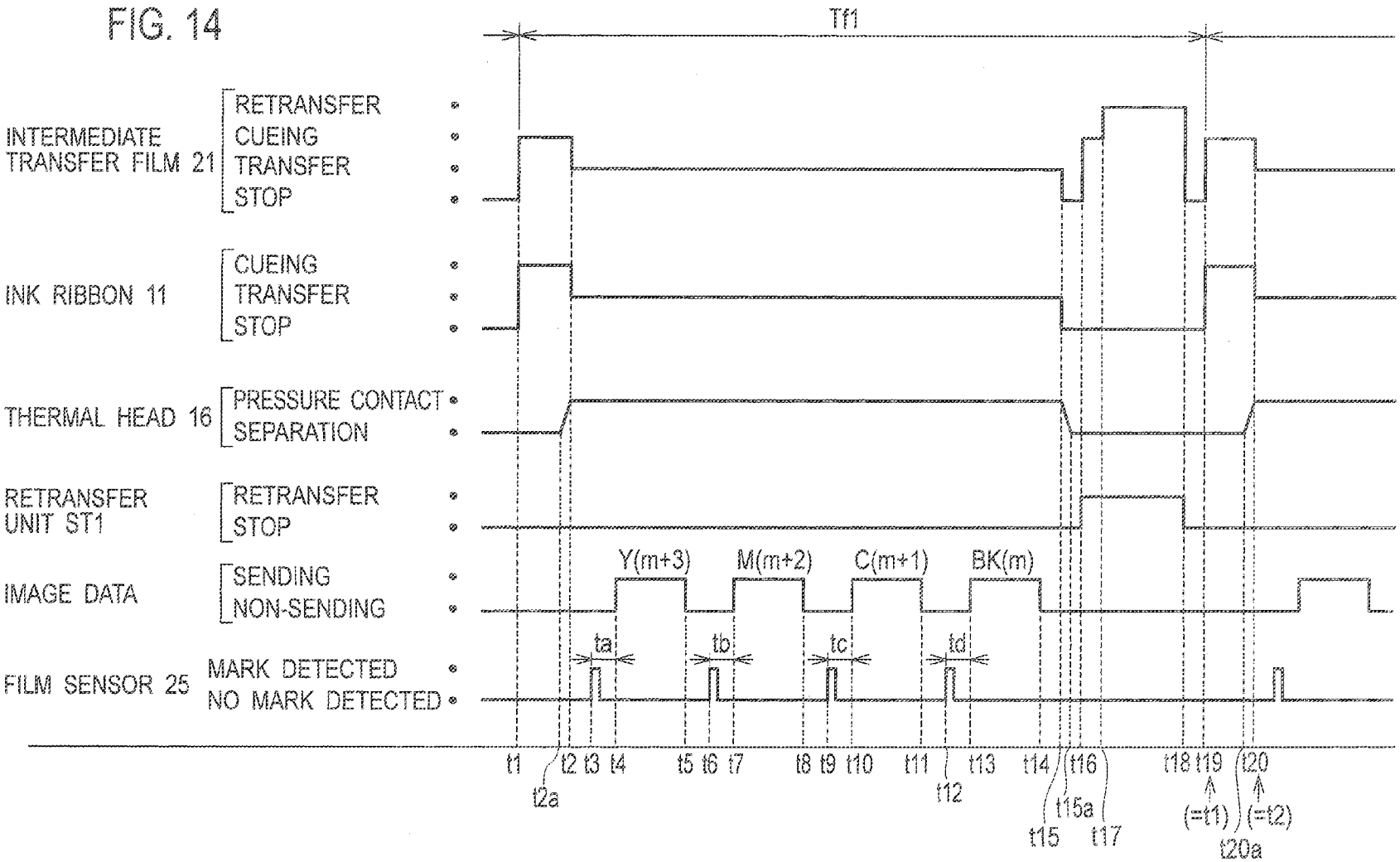

FIG. 14 is a timing chart for describing transfer operations by the image forming apparatus 51.

Figure 15:
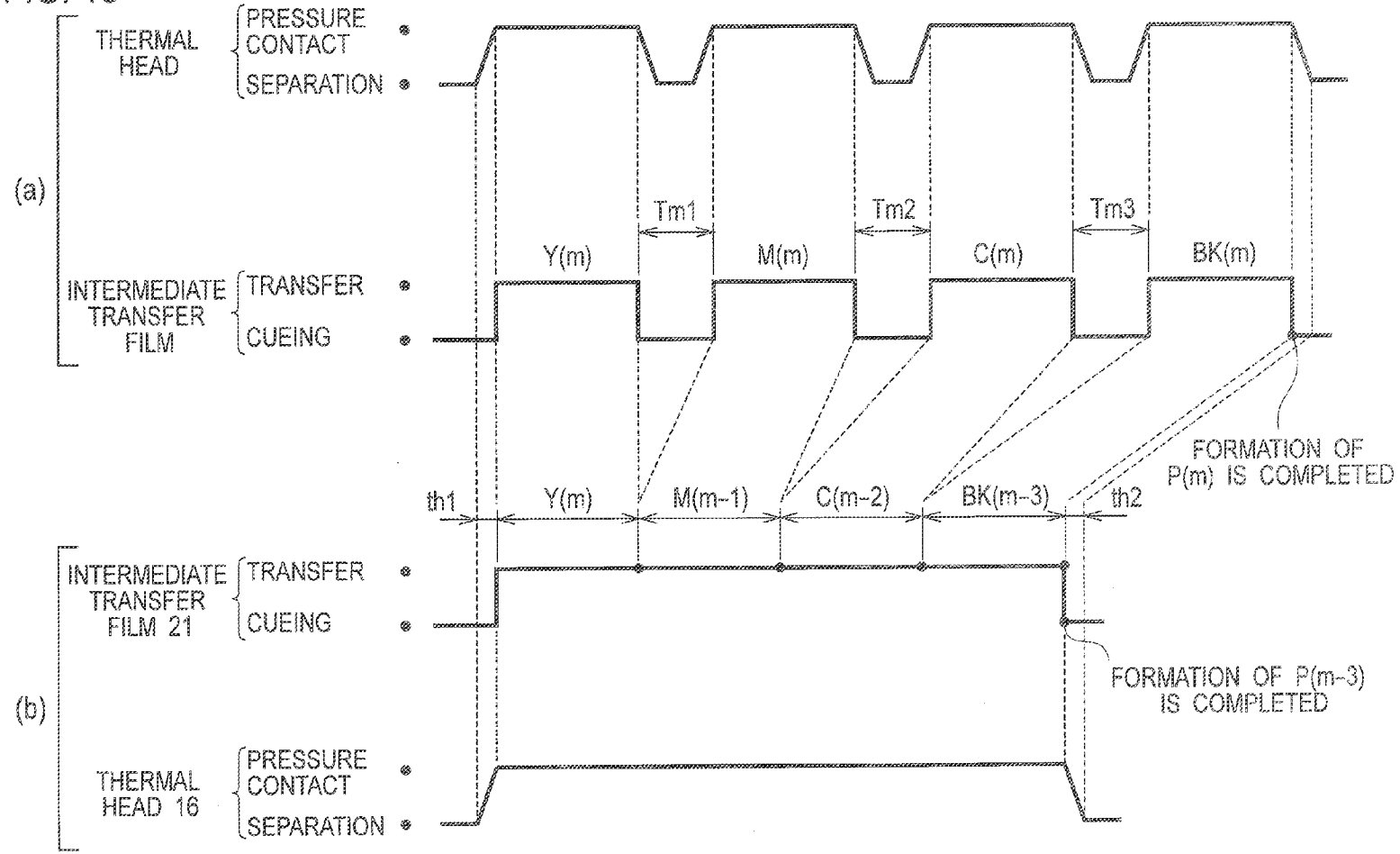

FIG. 15 is a view for describing effects exerted by the image forming apparatus 51: (a) of FIG. 15 shows a conventional method; and (b) of FIG. 15 shows a method executed by the image forming apparatus 51.

Figure 16:
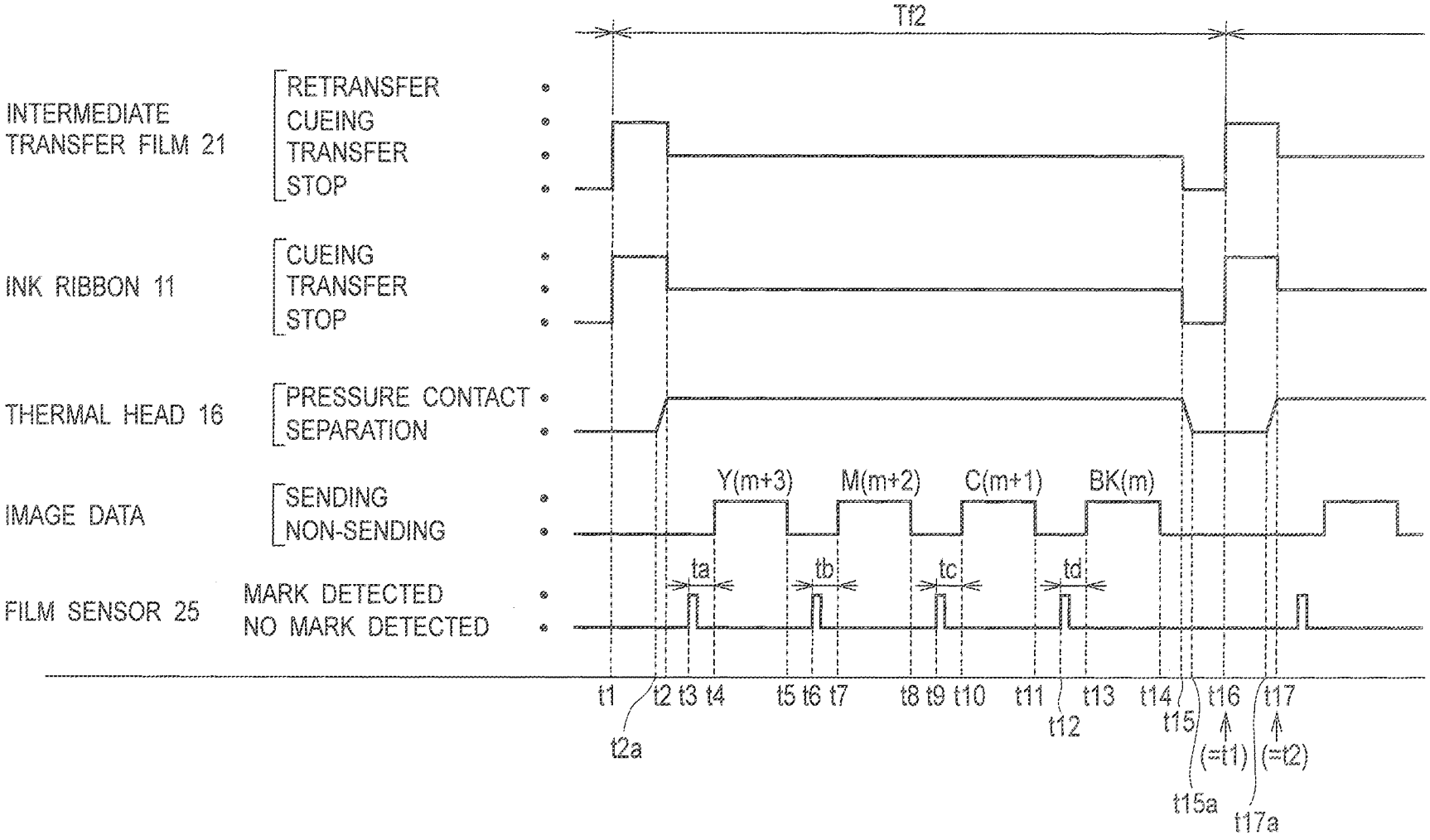

FIG. 16 is a timing chart for describing a modification example of the transfer operations by the image forming apparatus 51.

Figure 17:
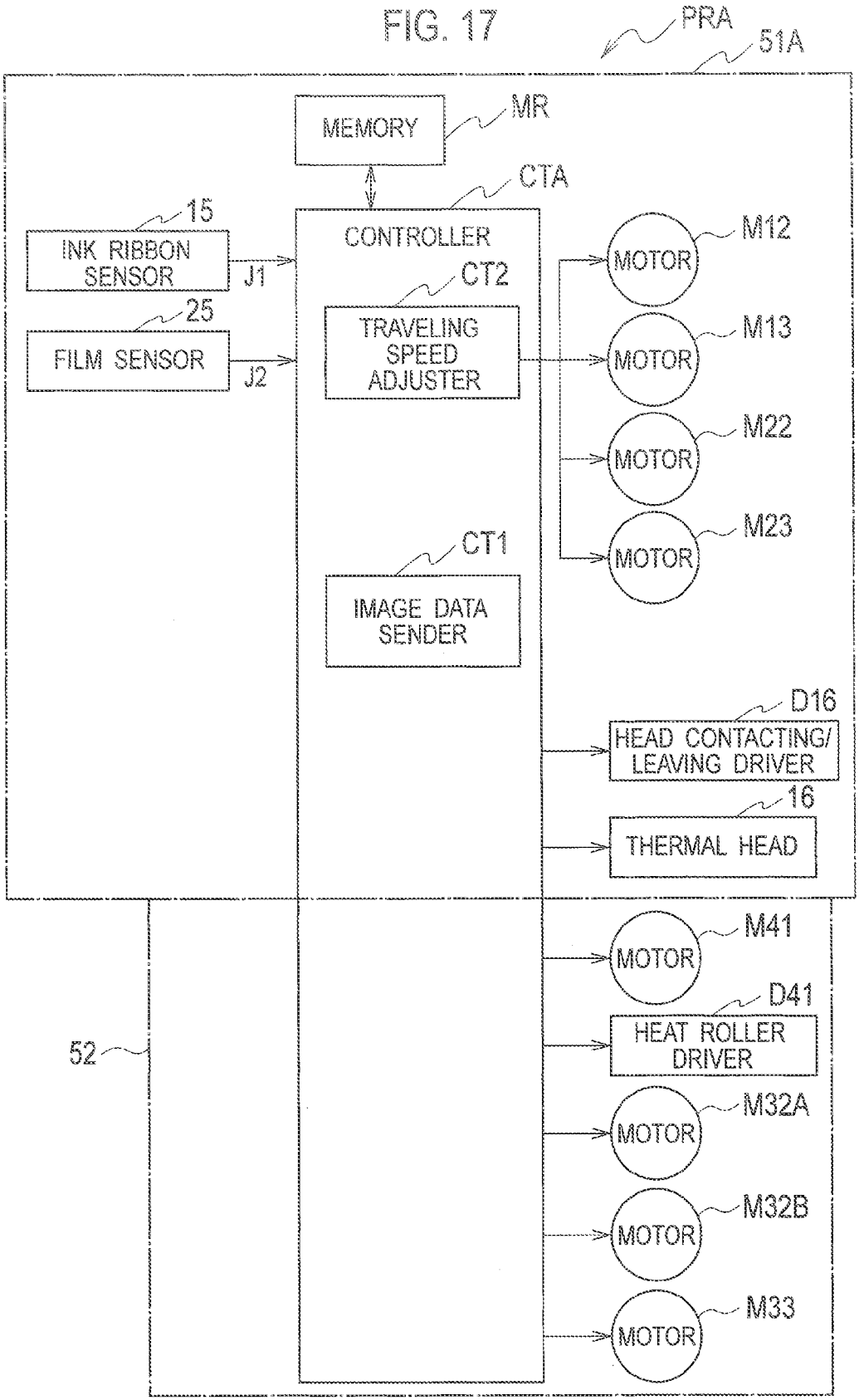

FIG. 17 is a block diagram showing a retransfer-system printer PRA, including an image forming apparatus 51A of the modification example.

Figure 18:
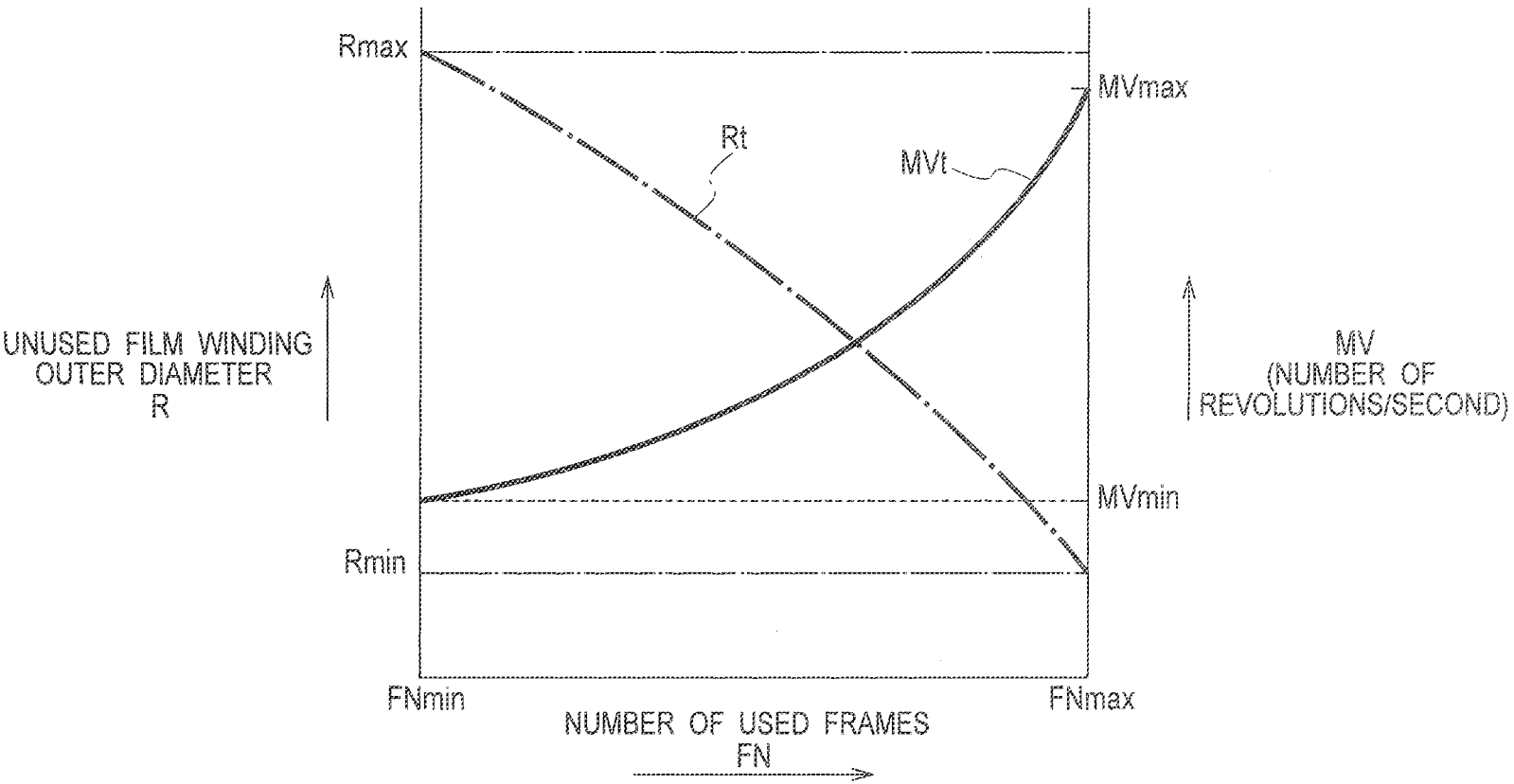

FIG. 18 is a graph showing relationships between a number of used frames and a winding outer diameter R of an unused film, between the number of used frames and a rotation speed MV of a motor M22, at which a transfer traveling speed V of the unused film becomes constant.

Figure 19:
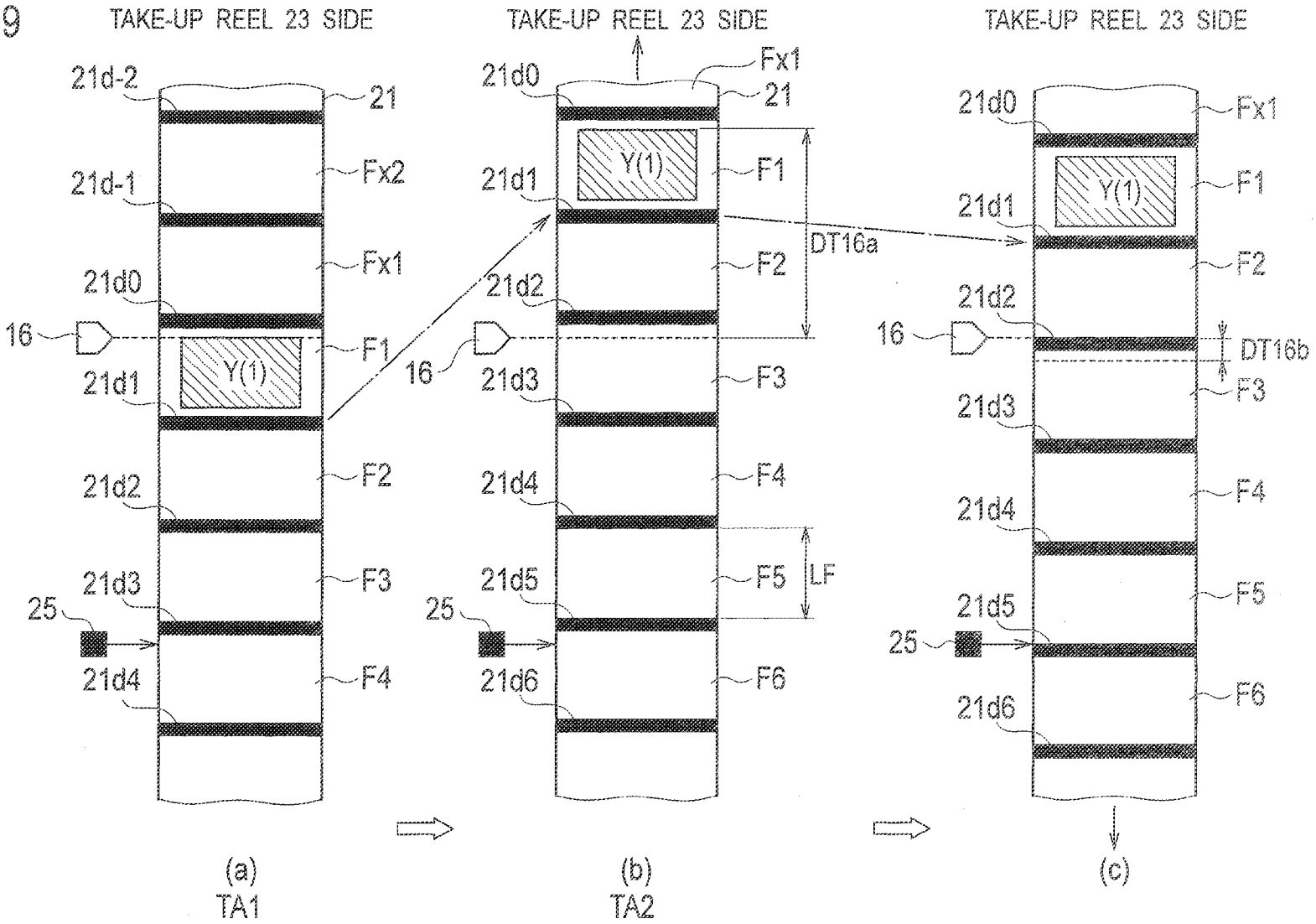

FIG. 19 is a view for describing a cueing operation after an image Y(1) in the image forming apparatus 51A is transferred.

Figure 20:
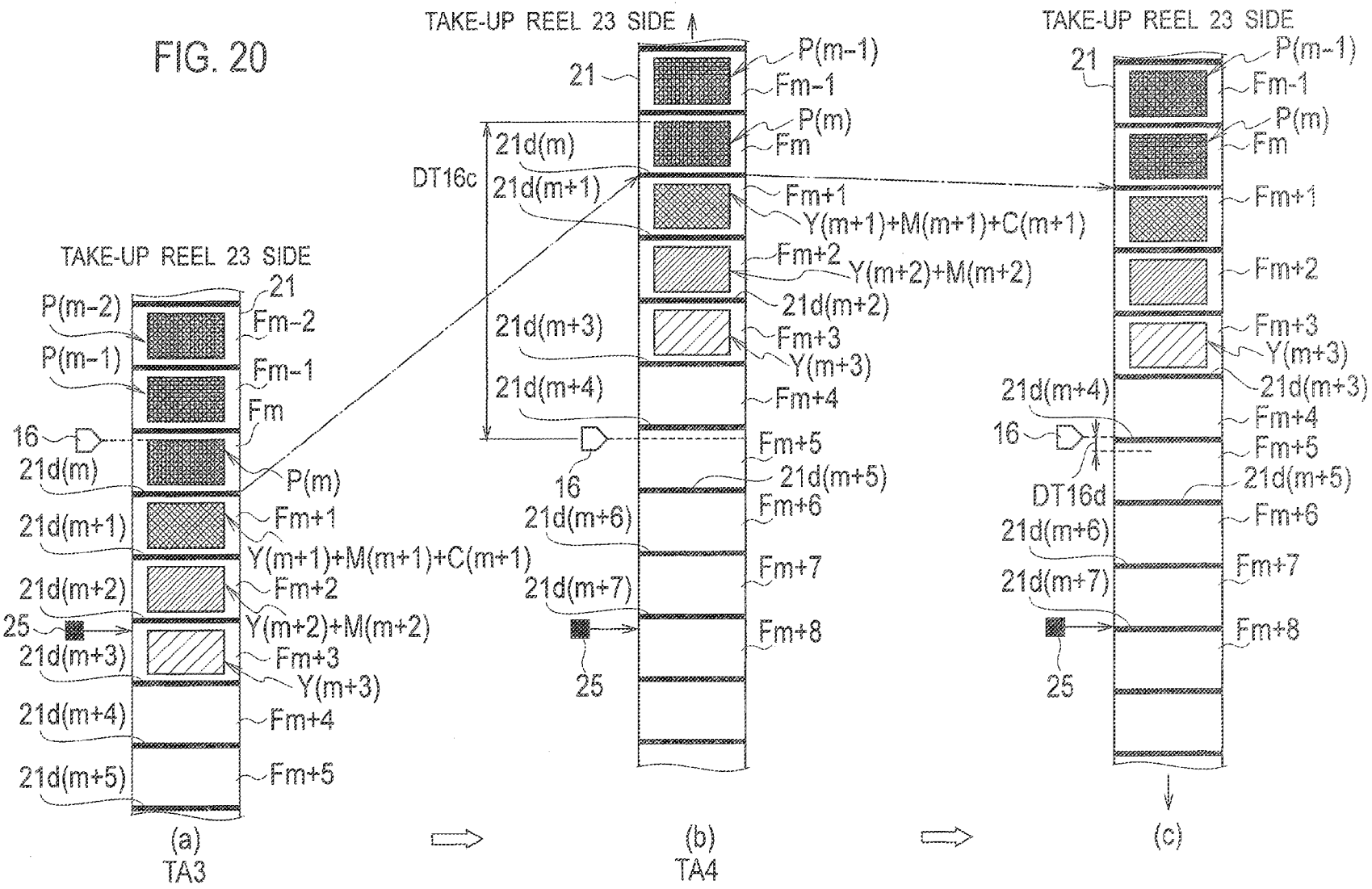

FIG. 20 is a view for describing a cueing operation after an intermediate image P(m) in the image forming apparatus 51A is formed.

Figure 21:
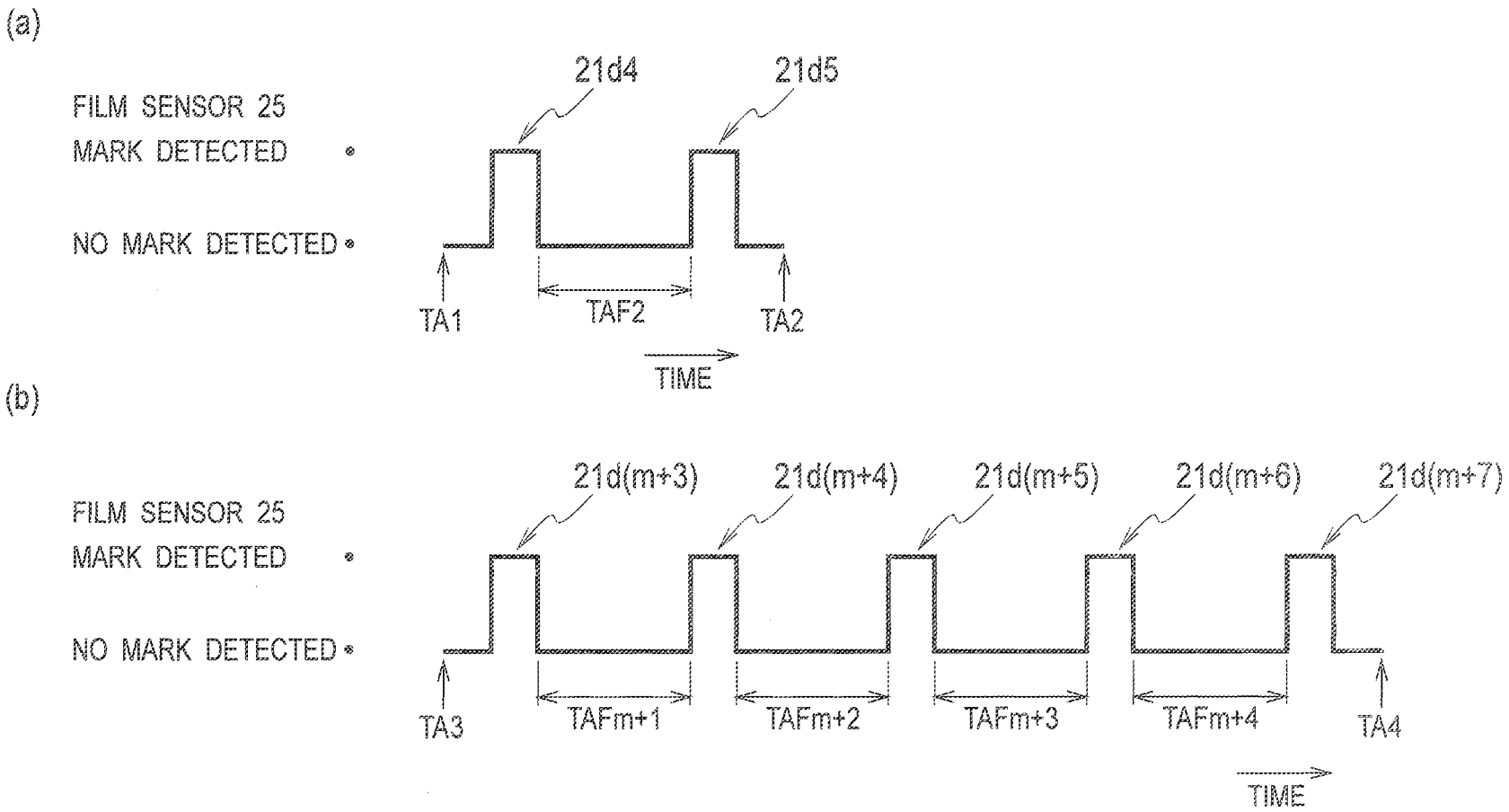

FIG. 21 is a view describing detection signals by a film sensor 25: (a) of FIG. 21 shows a detection signal in the cueing operation, shown in FIG. 19; and (b) of FIG. 21 shows a detection signal in the cueing operation, shown in FIG. 20.

Figure 22:
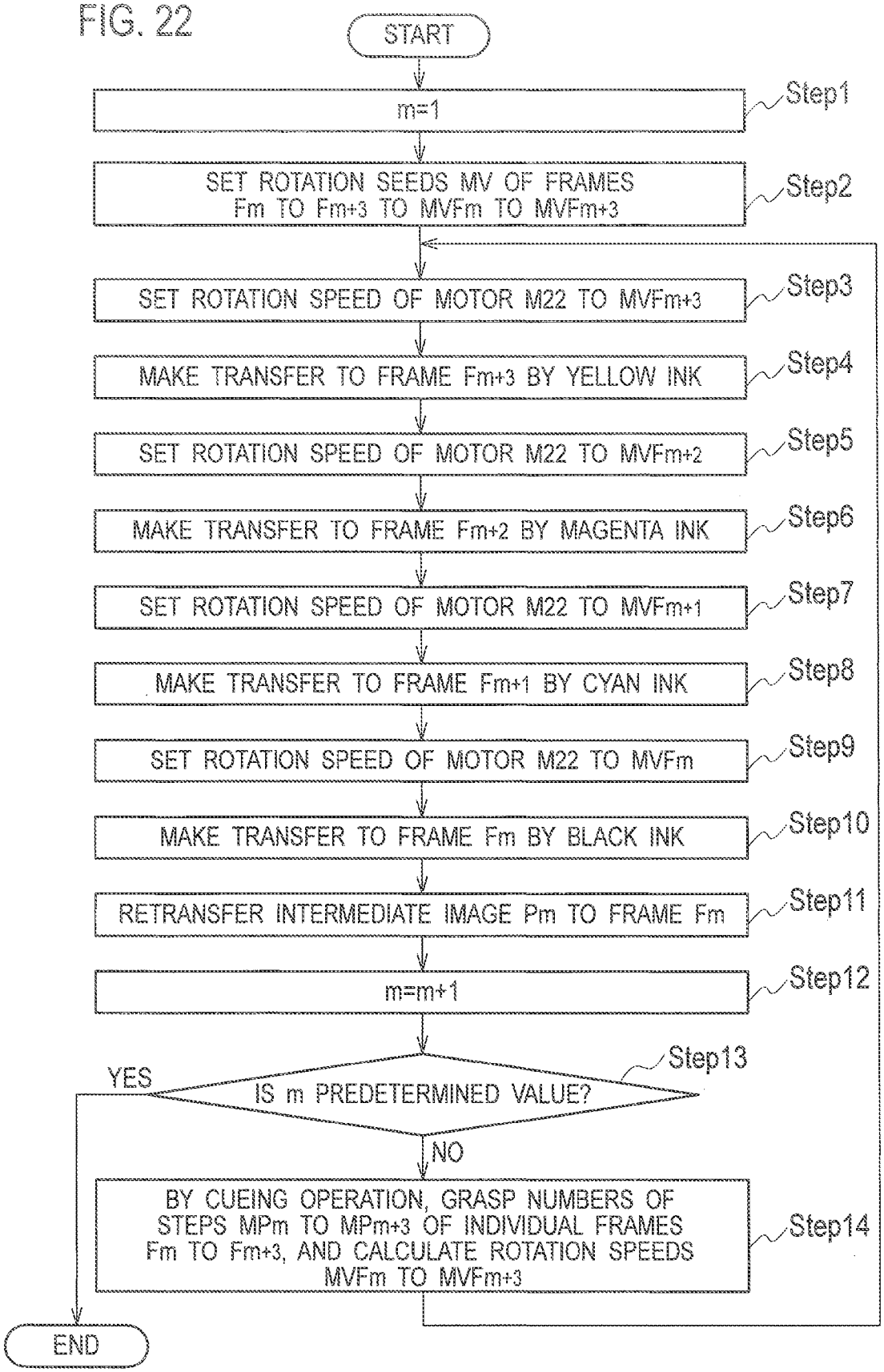

FIG. 22 is a flowchart for describing a procedure example of a speed adjustment method.

DETAILED DESCRIPTION

Referring to FIG. 1 to FIG. 16, a description is made of an image forming apparatus according to an embodiment by the image forming apparatus 51. First, referring to FIG. 1 to FIG. 5, a description is made of the retransfer-system printer PR (retransfer printer), configured by including the image forming apparatus 51.

Figure 1:
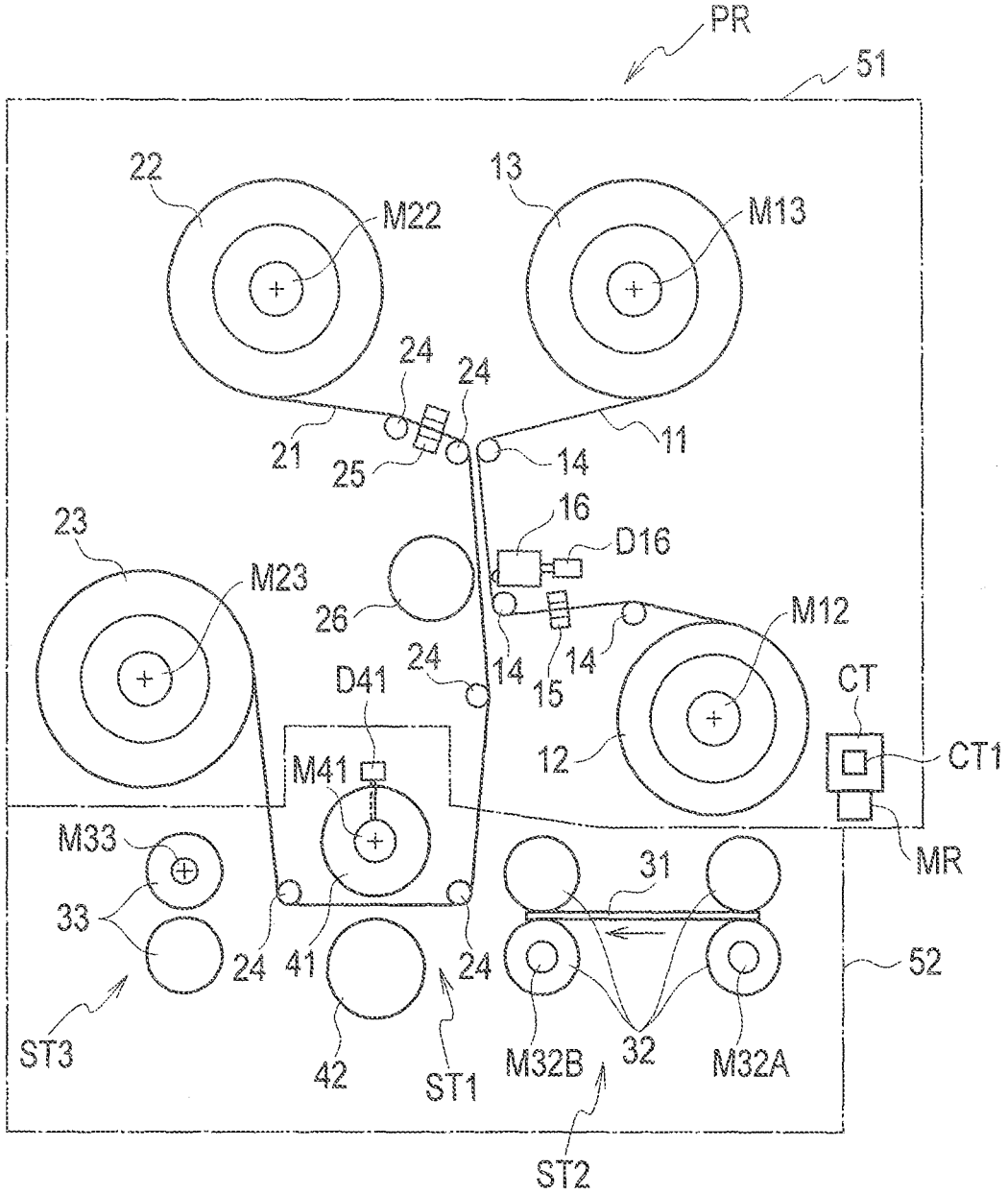
FIG. 1 is a schematic structure diagram showing a retransfer-system printer PR, configured by including an image forming apparatus 51 that is an image forming apparatus according to at least one embodiment.

In the right region of FIG. 1 of the printer PR, a supply reel 12 and a take-up reel 13 for the ink ribbon 11 are attached, with the capability of being detached. The supply reel 12 and the take-up reel 13 rotate by the drive of a driving motor M12 and a driving motor M13, respectively. Rotation speeds and rotation directions of the motors M12 and M13 are controlled by a controller CT provided in the printer PR.

Between the supply reel 12 and the take-up reel 13, the ink ribbon 11 is guided by a plurality of guide shafts 14, and extended along a predetermined traveling route. Near the supply reel 12 in the traveling route of the ink ribbon 11, an ink ribbon sensor 15 is disposed for cueing. The ink ribbon sensor 15 detects cue marks 11*d* (refer to FIG. 3) of the ink ribbon 11, and sends out ribbon mark detection information J1 (refer to FIG. 2) toward the controller CT.

The thermal head 16 is disposed between the ink ribbon sensor 15 and the take-up reel 13 in the traveling route of the ink ribbon 11. The thermal head 16 contacts and leaves a ribbon base 11*a*-side surface (refer to FIG. 3) of the extended ink ribbon 11 (in an arrow Da direction of FIG. 5). Such contacting/leaving operations of the thermal head 16 are executed by a head contacting/leaving driver D16 under control of the controller CT.

In the left region of FIG. 1 of the printer PR, a supply reel 22 and a take-up reel 23 for an intermediate transfer film 21 that is a transfer target are attached, with the capability of being detached. The supply reel 22 and the take-up reel 23 rotate by the drive of the driving motor M22 and a driving motor M23, respectively. Rotation speeds and rotation directions of the motors M22 and M23 are controlled by the controller CT.

Between the supply reel 22 and the take-up reel 23, the intermediate transfer film 21 is guided by a plurality of guide shafts 24, and extended along a predetermined traveling route. Near the supply reel 22 in the traveling route of the intermediate transfer film 21, the film sensor 25 is disposed for cueing. The film sensor 25 detects frame mark 21*d* (refer to FIG. 4) of the intermediate transfer film 21, and sends out frame mark detection information J2 (refer to FIG. 2) toward the controller CT.

Between the film sensor 25 and the take-up reel 23 in the traveling route of the intermediate transfer film 21, a platen roller 26 is disposed. The platen roller 26 is a driven roller.

By the contacting/leaving operations by the head contacting/leaving driver D16, the thermal head 16 moves between the pressure contact position (position shown in FIG. 5), where the intermediate transfer film 21 and the ink ribbon 11 are sandwiched between the thermal head 16 and the platen roller 26, and are brought into pressure contact with each other and a separation position (shown in FIG. 1), where the intermediate transfer film 21 and the ink ribbon 11 are separated from each other. When the thermal head 16 is placed at the pressure contact position, transfer of ink is performed, which will be described later.

The ink ribbon 11 and the intermediate transfer film 21 are made capable of being taken up to the take-up reels 13 and 23 and being rewound to the supply reels 12 and 22 independently of each other by the operations of the motors M12 and M13 and the motors M22 and M23, respectively in a state where the thermal head 16 is placed at the separation position.

In a state where the thermal head 16 is placed at the pressure contact position, the ink ribbon 11 and the intermediate transfer film 21 are brought into intimate contact with each other, and are made movable to the supply reels 12 and 22 side, or the take-up reels 13 and 23 side.

Based on the control of the controller CT, the ink ribbon 11 and the intermediate transfer film 21 move by the rotation of the supply reels 12 and 22, the take-up reels 13 and 23 and the platen roller 26 by the drive of the motors M12, M13, M22, and M23.

At least the motors M12 and M13 compose an ink ribbon conveying mechanism that conveys the ink ribbon 11. At least the motors M22 and M23 compose a transfer target conveying mechanism that conveys the intermediate transfer film 21 that is a transfer target. In a state where the thermal head 16 is brought into pressure contact with the platen roller 26, and the ink ribbon 11 and the intermediate transfer film 21 are in intimate contact with each other, the motor M22 may compose the ink ribbon conveying mechanism and the transfer target conveying mechanism.

The controller CT includes an image data sender CT1. When the thermal head 16 is placed at the pressure contact position, the image data sender CT1 sends out image data which is transferred to the intermediate transfer film 21, and to the thermal head 16 at the appropriate timing. Based on the frame mark detection information J2 and the like, the controller CT decides the timing of when the image data sender CT1 sends out the image data.

As shown in (a) and (b) of FIG. 3, the ink ribbon 11 includes: a belt-like ribbon base 11*a*; and an ink layer 11*b* coated and formed on the ribbon base 11*a*.

On the ink layer 11*b*, ink sets 11*b*1, each of which is a set of ink layers of plural colors (here, four colors) arrayed in a conveying direction of the ink ribbon 11, are coated while being repeated along the conveying direction. The conveying direction is a longitudinal direction of the ink ribbon 11, and is a direction where the ink ribbon 11 is conveyed to the supply reel 12 side or the take-up reel 13 side.

Each of the ink sets 11*b*1 are composed of a yellow ink layer Y, a magenta ink layer M, a cyan ink layer C, and a black ink layer BK, and are coated in this order in the conveying direction. The cue mark 11*d* is formed on one edge portion in a boundary region of each yellow ink layer Y, with the black ink layer BK adjacent thereto. A length La in the conveying direction of the respective ink layers Y, M, C, and BK are the same therewith. Hence, a pitch Lap of the sets of the ink layer 11*b* is four times the length La.

The position of the ink ribbon sensor 15 is set so that, when the ink ribbon sensor 15 detects the cue mark 11*d*, the pressure contact position of the thermal head 16 can coincide with the position of the head edge in the conveying direction of the yellow ink layer Y. That is, a traveling route length from the pressure contact position to a detection position of the ink ribbon sensor 15 is set to integer times the pitch Lap.

As shown in (a) and (b) of FIG. 4, the intermediate transfer film 21 includes: a belt-like film base 21*a*; a peeling layer 21*b* and a transferred image receiving layer 21*c*, which are stacked and formed on the film base 21*a*. The width of the film base 21*a* is the same as the width of the ribbon base 11*a* of the ink ribbon 11.

On the film base 21*a* or the transferred image receiving layer 21*c*, frame marks 21*d* are repeatedly formed at a predetermined pitch Lb in the conveying direction. The conveying direction is the longitudinal direction of the intermediate transfer film 21, and is the direction where the intermediate transfer film 21 is conveyed to the supply reel 22 side or the take-up reel 23 side. Each of the frame marks 21*d* is formed across an overall width, in a direction perpendicular to the conveying direction.

The pitch Lb is the same as the length La in the ink ribbon 11 (La=Lb). Fields partitioned at the pitch Lb in the intermediate transfer film 21 are referred to as frames F. That is, the frame marks 21*d* are given to boundary regions between the respective frames.

The position of the film sensor 25 is set so that, when the film sensor 25 detects the frame mark 21*d*, the pressure contact position of the thermal head 16 can coincide with the position of a head edge in the conveying direction of the frame mark 21*d*. That is, a traveling route length from the pressure contact position to the detection position of the film sensor 25 is set to integer times the pitch Lb.

In the image forming apparatus 51 as shown in FIG. 5, the intermediate transfer film 21 and the ink ribbon 11 are extended in an orientation where the transferred image receiving layer 21*c* and the ink layer 11*b* are opposed to each other. The transferred image receiving layer 21*c* has a property of receiving and fixing the ink of the heated ink layer 11*b*.

In such a way, in the pressure contact state of the thermal head 16 which is shown in FIG. 5, the inks are transferred from the ink layer 11*b*, attached with pressure to the transferred image receiving layer 21*c*, and an image is formed on the transferred image receiving layer 21*c*. The inks are transferred in a heating pattern corresponding to the image data supplied to the thermal head 16.

The image forming apparatus 51, described above in detail, moves the ink ribbon 11 and the intermediate transfer film 21, which are set by a user, while bring both thereof into intimate contact with each other. When the thermal head 16 is heated based on the supplied image data simultaneously with such intimate contact movement, the inks of the ink layer 11*b* of the ink ribbon 11 are transferred to the transferred image receiving layer 21*c* of the intermediate transfer film 21.

In such a way, a desired image can be formed on the frames F of the transferred image receiving layer 21*c*. Details of this image forming operation will be described later.

Figure 2:
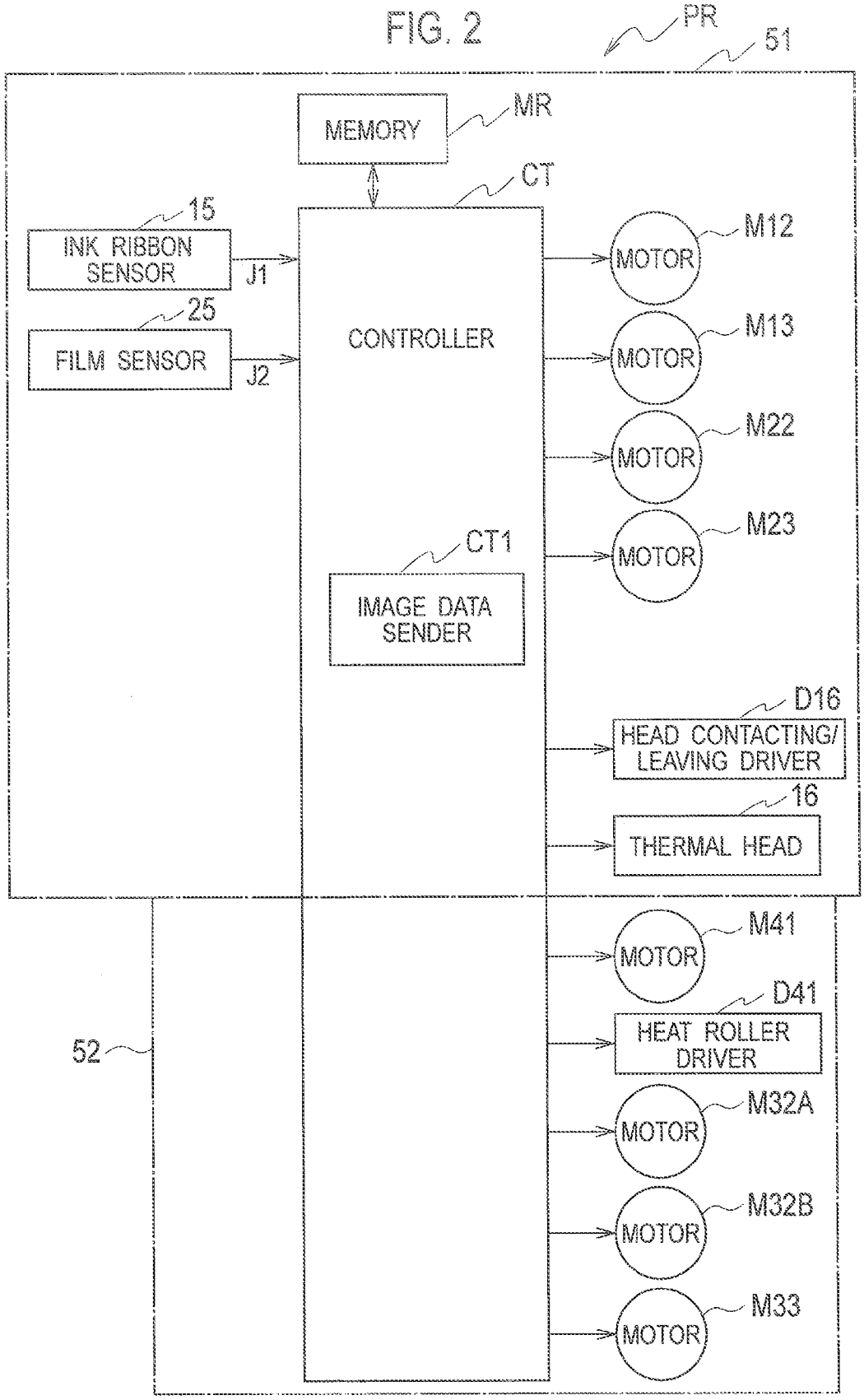
FIG. 2 is a block diagram showing the retransfer-system printer PR.

In FIG. 1 or FIG. 2, the printer PR includes a retransfer apparatus 52, that further retransfers the image which is formed on the transferred image receiving layer 21*c* (hereinafter, this image is also referred to as an intermediate image) to another transfer target. The retransfer apparatus 52 shares the controller CT with the image forming apparatus 51.

The retransfer apparatus 52 includes: a retransfer unit ST1 provided between the platen roller 26 and the take-up reel 23; a supply unit ST2 that supplies a transfer target 31 to the retransfer unit ST1; and a discharge unit ST3 that discharges the transfer target 31 passing through the retransfer unit ST1, wherein the retransfer unit ST1, the supply unit ST2, and the discharge unit ST3 are provided along the traveling route of the intermediate transfer film 21. For example, the transfer target 31 is a card. Hereinafter, the transfer target 31 is referred to as a card 31.

The retransfer unit ST1 includes: a heat roller 41; a motor M41 that rotationally drives the heat roller 41; a counter roller 42 disposed opposite to the heat roller 41; and a heat roller driver D41 that allows the heat roller 41 to contact and leave the counter roller 42.

The supply unit ST2 includes: two pairs of carry-in rollers 32, each pair of which is disposed apart from the other in the conveying direction (the right-and-left direction of FIG. 1), where the card 31 is conveyed while being sandwiched; and motors M32A and M32B which rotationally drive the carry-in rollers 32, each of which is one in the pair.

The discharge unit ST3 includes: a pair of discharge rollers 33, which sandwich and convey the card 31, and a motor M33 that rotationally drives one of the discharge rollers 33. Operations of the motors M41, M32A, M32B, M33, and the heat roller driver D41 are controlled by the controller CT.

In the retransfer apparatus 52, the card 31, supplied from the right outside of FIG. 1, is conveyed and supplied to the retransfer unit ST1 by the supply unit ST2.

In the retransfer unit ST1, by the operation of the heat roller driver D41, the intermediate transfer film 21 and the card 31 are brought into contact and sandwiched between the heated heat roller 41 and the counter roller 42, and are moved toward the discharge unit ST3 by the drive of the motor M41. In this movement, the transferred image receiving layer 21*c* is brought into pressure contact with the card 31.

In this pressure-contact movement, the image formed on the transferred image receiving layer 21*c* by the image forming apparatus 51 is transferred to the card 31. That is, the image is formed on the surface of the card 31 by the retransfer.

The card 31, on which the image is retransferred and formed, is conveyed to the discharge unit ST3 and is discharged, for example, to an external stocker.

The image forming apparatus 51 includes a memory MR connected to the controller CT. In the memory MR, there are stored in advance: an operation program for executing operations of the whole of the printer PR, including the image forming apparatus 51; transferred image information that is information of the image to be transferred; and the like. Stored contents in the memory MR are referred to by the controller CT, as appropriate.

The transferred image information is information indicating a type of the image (including a letter) to be printed on the frames F (card 31). The controller CT reads out the image data, which is included in the transferred image information from the memory MR, and the image data sender CT1 sends out the image data to the thermal head 16.

Next, mainly referring to FIG. 6 to FIG. 15, a description is made of the image forming operation and method to the intermediate transfer film 21 by the image forming apparatus 51.

In the transfer operations of the four colors, unlike the conventional method that requires a rewinding operation and a cueing operation in an event of transferring the respective colors, in the image forming method of the image forming apparatus 51, the transfer operations of four colors are continuously performed without being accompanied with the rewinding operation and the cueing operation. Hence, an image forming time can be shortened by the amount of the rewinding operation and the cueing operation.

Moreover, it is also possible to omit the contacting/leaving operations of the thermal head 16 which are required in the event of performing the rewinding operation and the cueing operation, and accordingly, the image forming time can also be shortened by that amount.

First, mainly referring to FIG. 6 to FIG. 10, a description is made of the procedure of forming an image P(1) on the first frame on which an image is formed.

FIG. 6 to FIG. 10 show positions and transfer contents of the ink ribbon 11 and the intermediate transfer film 21, with respect to the thermal head 16. Moreover, the surface of the ink layer 11*b* of the ink ribbon 11 and the transferred image receiving layer 21*c* of the intermediate transfer film 21, which are brought into intimate contact with and opposed to each other in the transfer operations, are illustrated so as to be arrayed.

In FIG. 6 to FIG. 10, for the sake of convenience, serial numbers beginning from 1 are assigned to the ink sets 11*b*1 served for the transfer. For example, Y1 to BK1 indicate a yellow ink layer to a black ink layer in the first set.

With regard to the frames F, serial numbers beginning from 1 are assigned thereto in a frame order of forming such images. For example, F1 indicates a frame on which the image is formed for the first time, F2 indicates a frame on which the image is formed for the second time, and F3 indicates a frame on which the image is formed for the third time.

Ink sets Yx to BKx and frames Fx in which x is annexed to reference symbols, are indicated to be ink sets and frames which are unused.

The images to be transferred are indicated by serial numbers with parentheses. For example, the image Y(1) shown in FIG. 6, means to be the first image (the image formed on the frame F1) to be transferred by the yellow ink layer Y. The image Y(2) shown in FIG. 7, means to be the second image (image formed on the frame F2) to be transferred by the yellow ink layer Y.

In a similar way, the image C(2) shown in FIG. 9, means to be the second image (the image formed on the frame F2) to be transferred to the cyan ink layer C, and the image M(3) shown in FIG. 9, means to be the third image (the image formed on the frame F3) to be transferred to the magenta ink layer M.

In the ink ribbon 11 in FIG. 7 to FIG. 12, hatched ink layers are ink layers used for the transfer.

First, as shown in FIG. 6, the controller CT individually cues the yellow ink layer Y1 and the frame F1, and aligns the positions of both thereof with each other.

Next, while turning the thermal head 16 to the pressure contact state and intimately moving the ink ribbon 11 and the intermediate transfer film 21 downward in FIG. 6 in an intimate contact state, the thermal head 16 transfers the image Y(1) to the frame F1 by the ink of the yellow ink layer Y1.

The controller CT intimately moves the ink ribbon 11 and the intermediate transfer film 21, by the amount of one frame. In this case, feeding directions are in the taking-up direction (forward-feeding direction) in the ink ribbon 11, and in the rewinding direction (reverse-feeding direction) in the intermediate transfer film 21.

When the transfer of the image Y(1) to the frame F1 is completed, the controller CT places the thermal head 16 into the separation position, and as shown in FIG. 7, individually cues the yellow ink layer Y2 and the frame F2, aligning the positions of both thereof with each other. That is, the controller CT feeds the ink ribbon 11 forward to the take-up reel 13 side by the amount of three ink layers (M1, C1, BK1), and feeds the intermediate transfer film 21 forward by the amount of two frames, which is the frame F1 and the frame F2.

Next, as shown in FIG. 7, while turning the thermal head 16 to the pressure contact state and intimately moving the ink ribbon 11 and the intermediate transfer film 21 downward, the thermal head 16 transfers the image Y(2) to the frame F2 by the ink of the yellow ink layer Y2. The controller CT intimately moves the ink ribbon 11 and the intermediate transfer film 21 by the amount of two frames.

When the transfer of the yellow ink layer Y2 is completed, the thermal head 16 subsequently transfers the image M(1) to the frame F1 by the ink of the magenta ink layer M2 without changing the traveling speed.

By the transfer of the image Y(2) and the image M(1) by the movement of the amount of two frames, the image Y(2) is formed on the frame F2, and the images Y(1) and the image M(1) are superimposed on the frame F1.

When the transfer of the image M(1) to the frame F1 is completed, the controller CT places the thermal head 16 into the separation position, and as shown in FIG. 8, individually cues the yellow ink layer Y3 and the frame F3, aligning the positions of both thereof with each other. That is, the controller CT feeds the ink ribbon 11 forward to the take-up reel 13 side by the amount of two ink layers (the cyan ink layer C2 and the black ink layer BK2), and feeds the intermediate transfer film 21 forward by the amount of three frames, which are the frames F1 to F3.

Next, as shown in FIG. 8, while turning the thermal head 16 to the pressure contact state and intimately moving the ink ribbon 11 and the intermediate transfer film 21 downward, the thermal head 16 transfers the image Y(3) to the frame F3 by the ink of the ink layer Y3.

When the transfer of the yellow ink layer Y3 is completed, the thermal head 16 subsequently transfers the image M(2) to the frame F2 by the ink of the magenta ink layer M3, without changing the traveling speed.

When the transfer of the magenta ink layer M3 is completed, the thermal head 16 subsequently transfers the image C(1) to the frame F1 by the ink of the cyan ink layer C3, without changing the traveling speed.

By the transfer of the images Y(3), M(2), and C(1) by the movement of the amount of three frames, the image Y(3) is formed on the frame F3. The image Y(2) and the image M(2) are transferred and superimposed to the frame F2. The image Y(1), the image M(1), and the image C(1) are transferred and superimposed to the frame F1.

When the transfer of the image C(1) to the frame F1 is completed, the controller CT places the thermal head 16 into the separation position, and as shown in FIG. 9, individually cues the yellow ink layer Y4 and the frame F4, aligning the positions of both thereof with each other. That is, the controller CT feeds the ink ribbon 11 forward to the take-up reel 13 side by the amount of one ink layer (black ink layer BK3), and feeds the intermediate transfer film 21 forward by the amount of four frames, which are the frames F1 to F4.

Next, as shown in FIG. 9, while turning the thermal head 16 to the pressure contact state and moving the ink ribbon 11 and the intermediate transfer film 21 downward, the thermal head 16 transfers the image Y(4) to the frame F4 by the ink of the yellow ink layer Y4.

When the transfer of the yellow ink layer Y4 is completed, the thermal head 16 subsequently transfers the image M(3) to the frame F3 by the ink of the magenta ink layer M4, without changing the traveling speed.

When the transfer of the magenta ink layer M4 is completed, the thermal head 16 subsequently transfers the image C(2) to the frame F2 by the ink of the cyan ink layer C4, without changing the traveling speed.

When the transfer of the ink layer C4 is completed, the thermal head 16 subsequently transfers the image BK(1) to the frame F1 by the ink of the black ink layer BK4, without changing the traveling speed.

By the transfer of the images Y(4), M(3), C(2), and BK(1) by the movement of the amount of four frames, the image Y(4) is formed on the frame F4. The image Y(3) and the image M(3) are transferred and superimposed to the frame F3. The image Y(2), the image M(2), and the image C(2) are transferred and superimposed to the frame F2.

Moreover, the image Y(1), the image M(1), the image C(1), and the image BK(1) are transferred and superimposed to the frame F1, and the formation of the color image P(1) by four colors which are yellow, magenta, cyan, and black is completed. Such a color image in which the transfer by the inks of four colors is completed is defined as a complete image.

In the case where the number of colors of the ink sets is generalized to n (n is an integer of 2 or more), the procedure of forming the first complete image P(1) in such an image forming operation as forming the complete images P(1) to P(n) on the continuous n pieces of transfer regions (frames) F1 to Fn is described as follows.

The image forming apparatus 51 uses the continuous 1st to n-th ink sets 11*b*1. The image forming apparatus 51 transfers the inks of the 1st to k-th ink layers of the k-th (integer satisfying $1 \leq k \leq n$) ink set to the k-th to 1st frames Fk to F1 among the frames F1 to Fn in forms of images corresponding to the complete images P(k) to P(1), formed on the respective frames Fk to F1.

Correspondence between the inks and the frames in this case is reverse correspondence in which a series of 1 to k in both thereof are allowed to correspond to each other in an ascending order for one thereof and a descending order for other thereof. For example, the image forming apparatus 51 transfers the ink of the first ink layer to the k-th frame Fk, and transfers the ink of the k-th ink layer to the first frame F1.

Then, the image forming apparatus 51 executes these transfer operations from k=1 to k=n, and can thereby form the first complete image P(1), in which the 1st to n-th inks are transferred and superimposed on the first frame F(1).

As shown in FIG. 10, the complete image P(1) formed on the frame F1 is retransferred to the transfer target. The retransfer apparatus 52 may execute the retransfer at an arbitrary timing. The intermediate transfer film 21, on which a plurality of the complete images is formed, may be detached from the image forming apparatus 51, and each of the plurality of complete images may be retransferred to the transfer target by another retransfer apparatus.

After the complete image P(1) is formed on the frame F1, an image of one frame F is formed by continuous transfer operations of four colors, which are the next transfer operations.

Accordingly, referring to FIG. 11 and FIG. 12, a description is made of the formation of an image P(m) onto an m-th (m is an integer of n or more) frame Fm.

FIG. 11 shows a state where the transfer of the inks of the respective colors, which are Y, M, and C, is completed for the m-th frame Fm, and before the continuous transfer of four colors which includes transfer of the remaining image BK(m) to the frame Fm.

That is, images Y(m), M(m), and C(m), are already transferred and superimposed to the frame Fm, images Y(m+1) and M(m+1) are transferred and superimposed to the frame Fm+1, and image Y(m+2) is transferred to the frame Fm+2. The m−1-th frame and the frames before the same are already subjected to the retransfer.

From this state, the image forming apparatus 51 executes a continuous transfer for the amount of four colors. That is, as shown in FIG. 11, the controller CT aligns a yellow ink layer Ym+3 and a frame Fm+3 with each other in the rewinding operation and the cueing operation.

Next, as shown in FIG. 11, while turning the thermal head 16 to the pressure contact state and intimately moving the ink ribbon 11 and the intermediate transfer film 21 downward, the thermal head 16 transfers the image Y(m+3) to the frame Fm+3 by the ink of the yellow ink layer Ym+3.

When the transfer of the yellow ink layer Ym+3 is completed, the thermal head 16 subsequently transfers the image M(m+2) to the frame Fm+2 by the ink of the magenta ink layer Mm+3, without changing the traveling speed.

When the transfer of the magenta ink layer Mm+3 is completed, the thermal head 16 subsequently transfers the image C(m+1) to the frame Fm+1 by the ink of the cyan ink layer Cm+3, without changing the traveling speed.

When the transfer of the cyan ink layer Cm+3 is completed, the thermal head 16 subsequently transfers the image BK(m) to the frame Fm by the ink of the black ink layer BKm+3, without changing the traveling speed.

By the transfer of the images Y(m+3), M(m+2), C(m+1), and BK(m) by the movement of the amount of four frames, as shown in FIG. 12, the image P(m) to which the images Y (m), M (m), C (m), and BK(m) are transferred and superimposed, is formed on the frame Fm.

In the case where the number of colors of the ink sets are generalized to n (n is an integer of 2 or more), the above-described procedure of the transfer operations can be represented as follows.

The transfer operations for the transfer regions as the first n spots, the transfer operations being described with reference to FIG. 6 to FIG. 10, are as follows.

The continuous n-spot transfer regions set on the intermediate transfer film 21 are named as the 1st to n-th transfer regions in a reverse direction, to an alignment sequence of the 1st to n-th ink layers in the ink sets. For the n-spot transfer regions, from k=1 to k=n, the controller CT executes transfer operations of transferring the inks of the ink layers of the 1st to k-th ($1 \leq k \leq n$) colors to the intermediate transfer film 21 by using the 1st to n-th ink sets. Then, a color image to which n-color inks are transferred is formed on the 1st transfer region.

Subsequently, for the 2nd to n-th transfer regions from q=2 to q=n, the controller CT executes transfer operations of transferring the inks of the ink layers of the q-th ($2 \leq q \leq n$) to n-th colors to the n-th to q-th transfer regions, by using the (n+1)-th to {n+(n−1)}-th ink sets. Then, color images to which the n-color inks are transferred are individually formed on the 2nd to n-th transfer regions.

At this time, the ink ribbon conveying mechanism and the transfer target conveying mechanism continuously convey the k-spot ink layers in the ink ribbon 11, and the k-spot transfer regions in the intermediate transfer film 21 in the same conveying direction. The controller CT executes transfer operations of continuously transferring the inks of the ink layers of the 1st to k-th colors to the k-th to the 1st transfer regions.

The transfer operations for the m-th frame Fm and after are as follows. In the embodiment in which n is 4, on the frame F5 and after, the following transfer operations are repeated unless the formation of the color images is discontinued.

The ink ribbon conveying mechanism and the transfer target conveying mechanism continuously convey the n-spot ink layers in the ink ribbon 11 and the n-spot transfer regions in the intermediate transfer film 21 in the same conveying direction. At this time, the controller CT executes transfer operations of continuously transferring the 1st to n-th ink layers in the n-spot ink layers to the 1st to n-th transfer regions in the intermediate transfer film 21, which are arrayed in the reverse direction to the alignment sequence of the ink layers, respectively.

Specifically, the inks of the yellow ink layer Y5 to the black ink layer BK5 are continuously transferred to the frames F5 to F2, respectively. The inks of the yellow ink layer Y6 to the black ink layer BK6 are continuously transferred to the frames F6 to F3, respectively. The inks of the yellow ink layer Y7 to the black ink layer BK7 are continuously transferred to the frames F7 to F4, respectively. Thereafter, a similar operation is repeated.

In such a way, there is repeated such an operation in which the color image to which the inks of the n colors are transferred is formed on the 1st transfer region, placed closest to the take-up reel 23 among the n-spot transfer regions in the intermediate transfer film 21.

In the event of the transfer operations in which the inks of the n-spot ink layers are transferred to the n-spot transfer regions, the cueing and aligning in position operations for the ink ribbon 11 and the intermediate transfer film 21 are unnecessary. Between a series of the continuous transfer operations for the n spots and the next series of the continuous transfer operations for the n spots, the cueing and aligning in position operations for the ink ribbon 11 and the intermediate transfer film 21 are performed.

Incidentally, in the case of discontinuing the formation of the color images in the final frame of the arbitrary final four frames in the intermediate transfer film 21, the controller CT just needs to make the control as shown in FIG. 13A to FIG. 13C.

Here, a description is made of an operation in the case of discontinuing the formation of the color images under the condition where the first four frames F1 to F4, described with reference to FIG. 6 to FIG. 10, are defined as the final four frames, and the frame F4 is defined as the final frame.

In FIG. 13A to FIG. 13C, hatched ink layers on the ink ribbon 11 show that the hatched ink layers concerned are already used for the transfer, and blank ink layers show that the blank ink layers concerned are no longer used for the transfer.

As shown in FIG. 13A, the controller CT intimately moves the ink ribbon 11 and the intermediate transfer film 21 downward by the amount of three frames. At this time, the thermal head 16 transfers the image M(4) to the frame F4 by the ink of the magenta ink layer M5, the thermal head 16 transfers the image C(3) to the frame F3 by the ink of the cyan ink layer C5, and the thermal head 16 transfers the image BK(2) to the frame F2 by the ink of the black ink layer BK5.

In such a way, a complete image by the inks of four colors is formed on the frame F2. FIG. 13B shows a state where the cyan ink layer C6 and the frame F4 are aligned in position with each other after the complete image of the frame F2 is retransferred to the transfer target.

As shown in FIG. 13B, the controller CT intimately moves the ink ribbon 11 and the intermediate transfer film 21 downward by the amount of two frames. At this time, the thermal head 16 transfers the image C(4) to the frame F4 by the ink of the cyan ink layer C6, and transfers the image BK(3) to the frame F3 by the ink of the black ink layer BK6.

In such a way, a complete image by the inks of four colors is formed on the frame F3. FIG. 13C shows a state where the black ink layer BK7 and the frame F4 are aligned in position with each other after the complete image of the frame F3 is retransferred to the transfer target.

As shown in FIG. 13C, the controller CT intimately moves the ink ribbon 11 and the intermediate transfer film 21 downward by the amount of one frame. At this time, the thermal head 16 transfers the image BK(4) to the frame F4 by the ink of the black ink layer BK7, and forms the final color image.

In the event of defining the n-th transfer region in the continuous n-spot transfer regions as the final transfer region, the controller CT needs only to control as follows. From r=1 to r=n, the controller CT executes transfer operations of transferring inks of ink layers of r-th to n-th colors in an r-th ($1 \leq r \leq n$) ink set to n-th to r-th transfer regions in the n-spot transfer regions by using the 1st to n-th ink sets. In such a way, the controller CT forms the final color image, in which the n-color inks are transferred to the n-th transfer region.

FIG. 13D shows a state of the ink ribbon 11 and transfer destinations of the respective inks at the time of forming the final color image onto the transfer region of an arbitrary final set. In a similar way to FIG. 13A to FIG. 13C, hatched ink layers on the ink ribbon 11 are the ink layers already used for the transfer, and blank ink layers are layers remaining without being used for the transfer.

In FIG. 13D, P(z) to P(z−3) are such complete images formed in the transfer regions of the arbitrary final set. z is a multiple of 4, which includes 4.

As is obvious from the above-mentioned operations in the formation of the first image P(1), when the image formation is started, the ink layers M1, C1, BK1, C2, BK2, and BK3 are unused.

In the transfer operations of forming the complete image P(z), with regard to the yellow ink layers Y, Yz+1 to Yz+3, which are placed after Yz served for P(z), are unused. With regard to the magenta ink layers M, Mz+2 and Mz+3, which are placed after Mz+1, are unused. With regard to the cyan ink layers C, Cz+3, which is placed after Cz+2 served for the complete image P(z), is unused.

In the image forming apparatus 51, after the first complete image P(1) is formed, in the transfer of the complete image P(2) to the complete image P(z−1) (hereinafter, this transfer is also referred to as continuous transfer), all of the respective ink layers of the ink ribbon are used for the transfer without causing the unused ink layers.

Next, referring to a timing chart shown in FIG. 14, a description is made of an example of a cooperative operation of the transfer operations in a continuous transfer by the image forming apparatus 51, and the retransfer operations by the retransfer apparatus 52.

In FIG. 14, a period Tf1 (time t1 to time t19) is the time required for the formation operations of one complete image, which is performed by the continuous transfer, and retransfer operations of the complete image. Here, a description is made of the transfer operations for four colors, in which the formation of the image P(m) is completed by the transfer of BK(m), and the retransfer operations of the formed image P(m); the transfer operations and the retransfer operations being shown in FIG. 11 and FIG. 12.

(1) Time t1 to t2

The controller CT cues the ink ribbon 11 and the intermediate transfer film 21. Based on the ribbon mark detection information J1 from the ink ribbon sensor 15 and the frame mark detection information J2 from the film sensor 25, the controller CT controls the respective motors to cue the ink ribbon 11 and the intermediate transfer film 21, so that the head position of the yellow ink layer and the head position at which the frame Fm+3 corresponds to the yellow ink layer Ym+3 can coincide with each other.

In such cueing, with respect to a frame mark 21*d*4 on a boundary between Fm+3 and Fm+4, the pressure contact position of the thermal head 16 is placed on an Fm+4 side as shown by a position B in FIG. 11. The position B is defined as a position apart from the frame mark 21*d*4 by at least the distance L16 or more.

During a period from the time t2*a* before the time t2 to the time t2, the controller CT moves the thermal head 16 from the separation position to the pressure contact position.

(2) Time t2 to t3

In FIG. 1 and FIG. 6, the controller CT places the thermal head 16 at the pressure contact position, rotates the platen roller 26, and allows the ink ribbon 11 and the intermediate transfer film 21 to travel in a direction downward. That is, the controller CT allows the ink ribbon 11 and the intermediate transfer film 21 to travel so that the thermal head 16 can move on the frame Fm+3. The traveling speed reaches a constant speed (predetermined transfer traveling speed) until the time t3.

The distance L16 is set to a distance equal to or more than the traveling distance (entrance length) required until the ink ribbon 11 and the intermediate transfer film 21 reach a constant speed in the start of the motor M22.

(3) Time t3

The film sensor 25 detects the frame mark 21*d*4 between the frame Fm+4 and the frame Fm+3, and outputs the frame mark detection information J2. Upon receiving the frame mark detection information J2, the controller CT monitors the elapsed time from the time t3.

(4) Time t4 to t6

When a predetermined time ta elapses from the time t3, the controller CT starts to supply the thermal head 16 with the image data of the yellow image Y(m+3) transferred to the frame Fm+3. In this example, ta=(t4−t3) and a supply time of the data is the time t4 to t5.

The predetermined time ta and the data supply time are determined in advance, in response to the yellow image Y(m+3) of the image P(m+3) formed on the frame Fm+3, the yellow image being included in the transfer image information stored in the memory MR. On and after the time t5, the controller CT waits for the arrival of the next frame mark detection information J2.

(5) Time t6

The film sensor 25 detects the frame mark 21*d*3 between the frame Fm+3 and the frame Fm+2, and outputs the frame mark detection information J2. Upon receiving the frame mark detection information J2, the controller CT monitors the elapsed time from the time t6.

(6) Time t7 to t9

When a predetermined time tb elapses from the time t6, the controller CT starts to supply the thermal head 16 with the magenta image data M(m+2), formed on the frame Fm+2. In this example, tb=(t7−t6) and a supply time of the data is the time t7 to t8.

The predetermined time tb and the data supply time are determined in advance, in response to the magenta image M(m+2) of the image P(m+2) formed on the frame Fm+2, the magenta image being included in the transfer image information. On and after the time t8, the controller CT waits for the arrival of the next frame mark detection information J2.

(7) Time t9

The film sensor 25 detects the frame mark 21*d*2 between the frame Fm+2 and the frame Fm+1, and outputs the frame mark detection information J2. Upon receiving the frame mark detection information J2, the controller CT monitors the elapsed time from the time t9.

(8) Time t10 to t12

When a predetermined time tc elapses from the time t9, the controller CT starts to supply the thermal head 16 with the cyan image data C(m+1) formed on the frame Fm+1. In this example, tc=(t10−t9) and a supply time of the data is the time t10 to t11.

The predetermined time tc and the data supply time are determined in advance, in response to the cyan image C(m+1) of the image P(m+1) formed on the frame Fm+1, the cyan image being included in the transfer image information. On and after the time t11, the controller CT waits for the arrival of the next frame mark detection information J2.

(9) Time t12

The film sensor 25 detects the frame mark 21*d*1 between the frame Fm and the frame Fm+1, and outputs the frame mark detection information J2. Upon receiving the frame mark detection information J2, the controller CT monitors the elapsed time from the time t12.

(10) Time t13 to t14

When a predetermined time td elapses from the time t12, the controller CT starts to supply the thermal head 16 with the black image data BK(m) formed on the frame Fm. In this example, td=(t13−t12) and a supply time of the data is the time t13 to t14.

The predetermined time td and the data supply time are determined in advance, in response to the black image BK(m) of the image P (m), formed on the frame Fm, the black image being included in the transfer image information.

(11) Time t14 to t15

At the time t14, the controller CT stops the supply of the image data of the black image BK(m), and completes the transfer operations at the time t15.

(12) Time t15 to t16

The time from the time t15 to the time t16 is the operation reset time from the transfer operations to the next retransfer operations. The controller CT stops the conveying of the intermediate transfer film 21 and the ink ribbon 11, and moves the thermal head 16 to the separation position (time t15 to t15*a*).

(13) Time T16 to t18

The duration from the time t16 to the time t18 is an execution time of the retransfer operations. The controller CT starts the retransfer operations of the retransfer unit ST1 at the time t16. The controller CT cues the intermediate transfer film 21 in order to retransfer the image P(m), which is formed on the intermediate transfer film 21 onto the card 31 in the retransfer unit ST1.

(14) Time t18 to t19

The duration from the time t18 to the time t19 is an operation reset time from the retransfer operations to the next transfer operations. The controller CT stops the traveling of the intermediate transfer film 21 and the ink ribbon 11, and maintains the position of the thermal head 16 at the separation position.

The time t19 corresponds to the time t1 of the next transfer operation. That is, the time t1 to the time t19 form the transfer operation period Tf1 for forming the complete image for one frame F.

At the above-described respective times, the printer PR executes the transfer and the retransfer operations by the cooperation of the image forming apparatus 51 and the retransfer apparatus 52.

FIG. 15 is a schematic view for describing switching between the transfer and the cueing in the image formation to the intermediate transfer film 21, together with the contacting/leaving operations of the thermal head 16. (a) of FIG. 15 shows a conventional method, and (b) of FIG. 15 shows a method executed by the image forming apparatus 51.

As mentioned above, in a method by the image forming apparatus 51 which is shown in (b) of FIG. 15, in the continuous transfer, the transfer of the inks is continuously performed from the ink ribbon 11 for the continuous four frames F(m+3) to F(m) of the intermediate transfer film 21 in the images Y(m+3), M(m+2), C(m+1), and BK(m), which correspond to the frames F(m+3) to F(m), respectively, and the image formation for the frame Fm is completed.

Hence, at the time when the transfer for four colors is started, taking up the forward-feeding and the cueing for four frames is only required for the intermediate transfer film 21, the cueing of the ink set is only required for the ink ribbon 11, and accordingly, the rewinding and the cueing are not required until the end of the transfer for four colors.

With regard to the thermal head 16, there are only performed: movement thereof from the separation position to the pressure contact position before the start of the transfer during a time th1; and movement thereof from the pressure contact position to the separation position after the end of the transfer during a time th2.

Meanwhile, in the conventional method as shown in (a) of FIG. 15, the transfer of the inks of the respective colors is sequentially performed from the ink ribbon to one frame F by the images corresponding to the frame F, and in each transfer operation of each color, the rewinding and the cueing operation for one frame is required. Moreover, in that event, the contacting/leaving operations of the thermal head are performed together with the above.

For example, in the case of performing the four-color transfer as in the embodiment, as a time required for the sum of the rewinding operation and the cueing operation for one frame, and the contacting/leaving operations of the thermal head, a time required for such operations performed three times, that is, a time Tm1 to a time Tm3 is required.

Hence, by using the image forming apparatus 51, the image forming time can be shortened by the amount of the total duration of time, Tm1, the time Tm2, and the time Tm3.

In the image forming apparatus 51, for example, in the transfer operations of the inks to the frame Fm, which is shown in FIG. 11, the controller CT is configured to decide the sending-out timing of the ink image data, which is to be transferred to the thermal head 16 while taking, as a reference, an arrival point of time of the frame mark detection information J2 of the frame mark 21*d*1 corresponding to the frame Fm.

Since the ink ribbon 11 and the intermediate transfer film 21 move at a constant speed, the sending-out timing can be measured by an elapsed time from the arrival point of time of the frame mark detection information J2.

In such a way, a transfer position in the conveying direction with respect to the frame Fm is maintained with high accuracy, and a color shift called misregistration is unlikely to occur.

The embodiment of the present invention is not limited to the above-mentioned configuration and procedure, and is modifiable within the scope without departing from the scope of the present invention.

As shown in FIG. 13D, among the unused ink layers of the ink ribbon which are generated at the starting and ending time of the group of the transfer operations executed continuously, the unused ink layers of the ink ribbon, which are generated at least at the ending time, are usable in the event of the next transfer operations (or after). Specifically, the unused ink layer Yz+1 generated at the ending time is usable as a yellow ink layer Y1 at the starting time of the next transfer operations.

A description is made of the respective ink layers for use in the transfer operations next to the group of transfer operations of transferring the complete images P(1) to P(z) shown in FIG. 13, by assigning serial numbers beginning from 1.

In a similar way, the ink layers Yz+2 and Mz+2 which are unused, are usable as ink layers Y2 and M2 at the starting time of the next transfer operations. In a similar way, the ink layers Yz+3, Mz+3, and Cz+3 which are unused, are usable as ink layers Y3, M3, and C3 at the starting time of the next transfer operations.

The controller CT may set a cueing position of the ink ribbon 11 at the starting time of the next transfer operations not to a position RB1 (refer to FIG. 13) that is a position at the previous ending time, but to a position RB2 where the ink set 11*b*1 is rewound by the amount of three sets from the position at the ending time. In such a way, the number of unused ink layers is reduced, thus making it possible to enhance utilization efficiency of the ink ribbon 11.

Note that, even when the rewinding of the unused ink layers is used, unused ink layers at the starting position of the ink ribbon 11 on one end side, and the ending portion of other end side thereof remain without being usable. However, since the ink ribbon 11 is extremely long, the unused ink layers which remain on both end sides are extremely small in an overall ratio, and a utilization efficiency enhancement effect brought by eliminating the unused ink layers in the intermediate portion is extremely high.

In the example described in FIG. 14, when the transfer image is formed on the intermediate transfer film 21, the retransfer operation is executed immediately. The retransfer operation is not limited to this, and may be executed later.

Moreover, the intermediate transfer film 21 may be detached from the image forming apparatus, and the retransfer may be performed by other retransfer apparatus. In such a case, the controller CT executes operations from which a portion of the retransfer operations are removed from the timing chart, shown in FIG. 14.

FIG. 16 shows operations in such a case of not performing the retransfer operations, but continuously executing the image formation to the frames F. That is, an image forming period Tf2 is a period from the time t1 to the time t16, from which the time t16 to the time t19 are removed, as shown in FIG. 14.

Moreover, the controller CT executes the cueing operation for the next transfer of the ink ribbon 11, of which execution is defined to be allowed at the time of the retransfer operations, at the same time t1 to t2 as that of the cueing of the intermediate transfer film 21.

The controller CT does not necessarily have to be provided in the image forming apparatus 51. An external computer or the like can also be used. In this case, the image forming apparatus 51 includes a communication unit (not shown) that enables signal transmission and reception with the external computer by wired or wireless connections.

In response to the image formed on the same frame F, the transfer of the plurality of colors to the frame F includes: a case of superimposition transfer in which the transfer images are superimposed on one another; and a case of independent transfer in which the transfer images are transferred independently to different places in the frame F.

Hence, the ink sets of the ink ribbon 11 are not limited to such a color configuration as described in the embodiment in which the full color image is formed by the superimposition, and an arbitrary color may be composed of an arbitrary number of colors.

In the embodiment, the description is made of such a configuration in which the thermal head 16 contacts and leaves the platen roller 26; however, the thermal head 16 and the platen roller 26 just need to be those which relatively contact and leave each other. That is, the platen roller 26 may contact and leave the thermal head 16, or both of the platen roller 26 and the thermal head 16 may contact and leave each other.

The controller CT may execute the cueing of the ink ribbon 11, which is performed for the transfer formation of the image P(m+1) in the time t19 to the time t20 in FIG. 14, by moving up the cueing concerned to a period during the retransfer operation at the time t16 to the time t18.

In the embodiment, the 1st to n-th ink sets for use are described as ink sets, all of which continue with one another; however, the ink sets are not limited to this. That is, the 1st to n-th ink sets for use may be those which partially continue with one another, or may be ink sets, any of which does not continue with the other.

The description is made of an example where the image forming apparatus 51 is combined with the retransfer apparatus 52 and mounted on the printer PR; however, the image forming apparatus 51 is not limited to this. The image forming apparatus 51 may be combined with other apparatus. As a matter of course, the image forming apparatus 51 may be a single apparatus.

As described above according to the embodiment, it becomes possible to form an image at high speed while suppressing the quality degradation of the image.

As mentioned above, the image forming apparatus 51 performs the transfer to the intermediate transfer film 21, while constantly maintaining the transfer traveling speed V, that is the traveling speed of the intermediate transfer film 21 with respect to the thermal head 16. That is, the transfer traveling speed V is maintained to be constant no matter what position in the longitudinal direction of the intermediate transfer film 21 the frame to be subjected to the transfer may be placed at.

This is for preventing a positional shift of each of the intermediate images P, which are transferred to the frames, the positional shift occurring for each frame, for preventing a color shift in each of the intermediate images, and for stabilizing the colors of the intermediate images.

A detailed description is made below. The unused intermediate transfer film 21 is supplied as one roll is wound around the supply reel 22. In that one roll, the intermediate transfer film 21 is wound around the supply reel 22, for example, with a bobbin diameter of 26 mm at a maximum winding diameter (diameter) of 57.4 mm. Moreover, the pitch Lb (refer to FIG. 3) of the frame marks 21*d* is set to 70 mm, and the length of the unused intermediate transfer film 21 corresponds to 1000 frames.

Hence, in the case of using a step motor as the motor M22 that rotationally drives the mounted supply reel 22, when the motor M22 is driven at an equal rotation speed (pulse interval) in the transfer to all of the frames, the winding diameter is reduced following the feeding of the intermediate transfer film 21, and the feeding length per step of the motor M22 is shortened. That is, the transfer traveling speed V becomes slower.

Accordingly, an image forming apparatus 51A of a modification example shown in FIG. 17 includes a traveling speed adjuster CT2 that adjusts the transfer traveling speed V to be constant in all of the frames, irrespective of the feeding length from the supply reel 22 of the intermediate transfer film 21 per step of the motor M22. The traveling speed adjuster CT2 controls the rotation speed of the motor M22 so that the transfer traveling speed V can be constant with high accuracy. Hereinafter, the rotation speed (number of revolutions/second) of the motor is referred to as a rotation speed MV.

FIG. 17 shows a retransfer-system printer PRA configured by including: an image forming apparatus 51A including a controller CTA, composed by providing the traveling speed adjuster CT2 in the controller CT; and the retransfer apparatus 52.

The traveling speed adjuster CT2 controls the operations of the motors M12, M13, M22, and M23, including the motor M22, which take part in the feeding operations of the intermediate transfer film 21, the ink ribbon 11, and application of back tension in the transfer operations.

A graph of FIG. 18 shows the relationships between a number of used frames FN of the intermediate transfer film 21, and a winding outer diameter R (mm) in the supply reel 22 of the intermediate transfer film 21 and between the number of used frames FN and the rotation speed MV (number of revolutions/second) of the motor M22 for constantly setting the transfer traveling speed V.

In this graph, the axis of abscissas represents the number of used frames FN, the left axis of ordinates represents the winding outer diameter R (corresponding diameter characteristics Rt is indicated by alternate long and short dashed lines), and the right axis of ordinates represents the rotation speed MV (corresponding rotation speed characteristics MVt are indicated by a solid line) of the motor M22.

A first method for controlling the rotation speed of the motor M22 is as follows. Such rotation speed characteristics MVt, which are based on one roll in which the unused intermediate transfer film 21 is wound around the supply reel 22 are obtained in advance, and are pre-stored in the memory MR.

The traveling speed adjuster CT2 grasps a number of used frames from an unused state thereof by the number of frame marks 21*d* detected by the film sensor 25, and controls the rotation speed MV of the motor M22 based on the stored rotation speed characteristics MVt.

Moreover, as a second method, the method described below may be used. First, the number of steps of PF (number/second) per unit time (second) for allowing the intermediate transfer film 21 to travel at a transfer traveling speed V (mm/second) is represented by Equation (1), where LF (mm) is a frame distance between the frame marks 21*d*, and MP (number) is the number of steps required for moving the intermediate transfer film 21 by the frame distance LF.

$$PF=V\times MP/LF \quad (1)$$

The number of steps of MP becomes a variable, varied in response to the feeding amount of the intermediate transfer film 21 from the supply reel 22. Hence, if the number of steps of MP of the motor M22 which is required to move the intermediate transfer film 21 by the frame distance LF is known for each frame, then the transfer traveling speed V can be constantly set by adjusting such a step interval.

That is, when a rotation angle of the motor M22 per step is θm (degree), then the rotation speed MV (number of revolutions/second) of the motor M22 is calculated by Equation (2) by using the number of steps of PF.

$$MV=PF/(360°/\theta m) \quad (2)$$

A description is made of a case where the traveling speed adjuster CT2 controls the speed of the motor M22 by the second method. The second method is referred to as a speed adjustment method. The speed adjustment method is a method of updating and optimizing the rotation speed MV (number of steps of PF per unit time) of the motor M22 for each of the frames, which are to be subjected to the transfer, in order to constantly set the transfer traveling speed V.

In the speed adjustment method, before the transfer operations, the traveling speed adjuster CT2 acquires the number of steps of PF (number/second) per second, at which the transfer traveling speed V is constantly set for each of the frames to be subjected to the transfer. Then, the number of steps of PF and the rotation speed MV calculated from the number of steps of PF by Equation (2) are stored as frame-corresponding speed information in the memory MR. The traveling speed adjuster CT2 acquires the number of steps of PF in the cueing operation, for example.

A description is made below in detail of the speed adjustment method.

<Regarding Speed Adjustment Method>

First, referring to FIG. 19, a description is made of a method of transferring the image Y(1) on the frame F1 of the intermediate transfer film 21, and setting a rotation speed MVF2 of the motor M22 for performing the transfer on the next frame F2, at a constant transfer traveling speed V in the operation of cueing the frame F2.

(a) of FIG. 19 shows a transfer ended state TA1 where the transfer of the image Y(1) to the frame F1 has ended. For facilitating the understanding, it is assumed that a rotation speed MVF1 in the event of transferring this image Y(1) is obtained in advance.

Moreover, it is assumed that the thermal head 16 and the film sensor 25 are provided apart from each other at an interval with a length three times the pitch Lb of the frame F. Hence, the film sensor 25 is placed on the frame F4 in a state where the thermal head 16 is present on the frame F1 to which the transfer of the image Y(1) is completed.

By the control of the controller CTA, the intermediate transfer film 21 is moved by forward winding from the transfer ended state TA1 to the take-up reel 23 side, and is turned to a cueing intermediate state TA2 shown in (b) of FIG. 19. The rotation speed of the motor M22 in this movement may be arbitrary.

By this movement from the transfer ended state TA1 to the cueing intermediate state TA2, the film sensor 25 passes through the frame mark 21*d*4 on the boundary between the frame F4, the frame F5, and the frame mark 21*d*5 on the boundary between the frame F5 and the frame F6.

Hence, the film sensor 25 detects the frame mark 21*d*4 and the frame mark 21*d*5, and outputs a detection signal, which is shown in (a) of FIG. 21, as the frame mark detection information J2.

Moreover, by this movement, the thermal head 16 also makes a relative movement by the distance DT16*b* from the frame F1 through the frame F2 to the frame F3. This movement of the intermediate transfer film 21 is a taking-up (forward-feeding) movement.

The traveling speed adjuster CT2 grasps a number of steps of MP2 of the motor M22, which is for allowing the intermediate transfer film 21 to move by the frame distance LF between the frame mark 21*d*4 and the frame mark 21*d*5. That is, the traveling speed adjuster CT2 grasps the number of steps of MP2 during a time TAF2, shown in (a) of FIG. 21.

This number of steps of MP2 corresponds to a number of steps, which are required for the thermal head 16 to relatively move the frame F2.

The traveling speed adjuster CT2 stores this number of steps of MP2 as number-of-revolution information, which is required for the motor M22 to move the frame F2 by the frame distance LF in the memory MR.

The traveling speed adjuster CT2 assigns the grasped number of steps of MP2 to MP in Equation (1), and obtains a number of steps of PF2 per unit time (second) for executing the transfer to the frame F2 at the same transfer traveling speed V as those of the other frames.

That is, PF2=V×(MP2)/LF is established.

Into the memory MR, the traveling speed adjuster CT2 stores the obtained number of steps of PF2 and the rotation speed MVF2, which is calculated from the number of steps of PF2 by Equation (2) as frame-corresponding speed information for obtaining the transfer traveling speed V in the frame F2.

Subsequently, as shown in (c) of FIG. 19, the controller CTA performs the rewinding (reverse-feeding) by the distance DT16*b*, so that the thermal head 16 can be placed on a frame F2-side end portion in the frame mark 21*d*2 on the boundary between the frame F2 and the frame F3, then ending the cueing operation.

After continuously executing the transfer of the image Y(2) to the frame F2 and the superimposition transfer of the image M(1) to the frame F1 subsequently to this cueing operation, the traveling speed adjuster CT2 executes a similar operation of grasping a number of steps of MP3 in the event of the cueing operation of the frame F3.

Then, the motor M22 is driven at a rotation speed MVF3 that is based on the number of steps of PF3, which is obtained by assigning the number of steps of MP3 to Equation (2) whereby the transfer is executed.

In such a way, the transfer of the image Y(3) to the frame F3 is performed at a transfer traveling speed V that is constant.

Next, referring to FIG. 20, a description is made of the cueing operation of the frame Fm+4, for which the transfer is started next, after the intermediate image P(m) with four colors superimposed is formed on the frame Fm, and of a method for setting the rotation speed MVFm+4 to MVFm+1 of the motor M22, in the event of the transfer to the frames Fm+4 to Fm+1.

(a) of FIG. 20 shows a transfer ended state TA3 where the formation of the intermediate image P(m) on the frame Fm is ended. The images Y(m+1), M(m+1), and C(m+1) are transferred and superimposed to the frame Fm+1, the images Y(m+2) and M(m+2) are transferred and superimposed to the frame Fm+2, and the image Y(m+3) is transferred to the frame Fm+3.

In the transfer ended state TA3, the thermal head 16 is placed at the frame Fm, and the film sensor 25 is placed at the frame Fm+3.

Here, a description is made of a case of continuously performing the formation of the next intermediate images without retransferring the formed intermediate image P(m). Hence, as shown in (a) of FIG. 20, the formed intermediate images P(m−1) and P(m−2) are left on the frames Fm−1 and Fm−2, respectively.

By the control of the controller CTA, the intermediate transfer film 21 is moved in forward winding from the transfer ended state TA3 shown in (a) of FIG. 20 to the take-up reel 23 side, and is turned to the cueing intermediate state TA4 shown in (b) of FIG. 20. That is, the film sensor 25 relatively moves from the frame Fm+3 to the frame Fm+8.

By this movement from the transfer ended state TA3 to the cueing intermediate state TA4, the film sensor 25 passes through five frame marks which are a frame mark 21*d*(m+3) on a boundary between a frame Fm+3, a frame Fm+4, and a frame mark 21*d*(m+7), on a boundary between a frame Fm+7 and a frame Fm+8.

Hence, the film sensor 25 detects five frame marks which are: the frame mark 21*d*(m+3) to the frame mark 21*d*(m+7), and outputs a detection signal, which is shown in (b) of FIG. 21, as the frame mark detection information J2.

By this movement, the position of the thermal head 16 also makes a relative movement by the movement distance DT16*c* through four frames from the frame Fm to the frame Fm+5. This movement of the intermediate transfer film 21 is a taking-up (forward-feeding) movement.

The traveling speed adjuster CT2 grasps numbers of steps MPm+1 to MPm+4 of the motor M22, which are for allowing the intermediate transfer film 21 to move by the frame distance LF between the respective frame marks, in the detection signal shown in (b) of FIG. 21. That is, the traveling speed adjuster CT2 grasps the numbers of steps MPm+1 to MPm+4 during a time TAFm+1 to TAFM+4, shown in (b) of FIG. 21. The numbers of steps of MPm+1 to MPm+4 are number-of-revolution information corresponding to numbers of steps, which are required for the thermal head 16 to relatively move the frames Fm+1 to Fm+4. The traveling speed adjuster CT2 stores the grasped numbers of steps MPm+1 to MPm+4 in the memory MR, as a set of the number-of-revolution information.

In a similar way to obtaining the number of steps of PF2, the traveling speed adjuster CT2 individually assigns the numbers of steps MPm+1 to MPm+4 to MP in Equation (1), and obtains numbers of steps PFm+1 to PFm+4 per unit time (second) for executing the transfer thereof to the frames Fm+1 to Fm+4 at the same transfer traveling speed V.

For example, PFm+1=V×(MPm+1)/LF is established.

The traveling speed adjuster CT2 stores the obtained numbers of steps PFm+1 to PFm+4 and the rotation speeds MVFm+1 and MVFm+4 into the memory MR, calculated from the numbers of steps PFm+1 to PFm+4 by Equation (2), in association with the frames Fm+1 to Fm+4, respectively.

Subsequently, as shown in (c) of FIG. 20, the controller CTA performs the rewinding (reverse-feeding) by the distance DT16*d*, so that the thermal head 16 can be placed on a frame Fm+4-side end portion of the frame mark 21*d*(m+4), on the boundary between the frame Fm+4 and the frame Fm+5, then ending the cueing operation.

Subsequent to this cueing operation, the controller CTA continuously executes the transfer of image Y(m+4) to the frame Fm+4, the superimposed transfer of image M(m+3) to the frame Fm+3, the superimposed transfer of image C(m+2) to the frame Fm+2, and the superimposed transfer of image BK(m+1) to the frame Fm+1.

In this transfer operation, the traveling speed adjuster CT2 switches the rotation speed of the motor M22 for each frame as follows.

In the transfer to the frame Fm+4, the traveling speed adjuster CT2 drives the motor M22 at the rotation speed MVFm+4, based on the number of steps of MPm+4. In the transfer to the frame Fm+3, the traveling speed adjuster CT2 drives the motor M22 at the rotation speed MVFm+3, based on the number of steps of MPm+3. In the transfer to the frame Fm+2, the traveling speed adjuster CT2 drives the motor M22 at the rotation speed MVFm+2, based on the number of steps of MPm+2. In the transfer to the frame Fm+1, the traveling speed adjuster CT2 drives the motor M22 at the rotation speed MVFm+1, based on the number of steps of MPm+1.

In such a way, in the transfer to the frames Fm+4 to Fm+1, the transfer traveling speed V of the intermediate transfer film 21 becomes constant.

In the case of further executing the transfer continuously from this stage without performing the retransfer, the controller CTA performs a cueing operation of the frame Fm+5 in a similar way to the cueing operation of the frame Fm+4, and the traveling speed adjuster CT2 executes operations of grasping numbers of steps MPm+2 to MPm+5.

The traveling speed adjuster CT2 drives the motor M22 at rotation speeds MVFm+5 to MVFm+2, based on the numbers of steps MPm+5 to MPm+2 per predetermined unit time (second) for the frames Fm+5 to Fm+2, respectively, and thereby executes the transfer at the constant transfer traveling speed V.

As described above, in a case of continuously forming the intermediate images on the frames by using the speed adjustment method without interposing the retransfer operations, for example, the numbers of steps MPm+2 to MPm+4 in the numbers of steps MPm+1 to MPm+4, which are grasped by the cueing operation, corresponds to the frame Fm+1 to the frame Fm+4. These can be used as the number-of-revolution information for acquiring the individual transfer traveling speeds V for the frames Fm+2 to Fm+4 in the transfer to the frames Fm+5 to Fm+2, performed in the formation of the intermediate image to the next frame Fm+5.

Accordingly, in this case, the traveling speed adjuster CT2 may grasp only the number of steps of MPm+5, which correspond to the frame Fm+5, a frame newly subjected to the transfer in the cueing operation.

Meanwhile, for example, in the case of retransferring the intermediate image P after forming the intermediate image P(m) on the frame Fm as shown in FIG. 20, and before forming the intermediate image onto the next frame Fm+1, it is recommended to adopt the following procedure.

By executing the cueing operation described with reference to FIG. 20 and (b) of FIG. 21, the traveling speed adjuster CT2 newly grasps the numbers of steps Mpm+4 to MPm+1, which correspond to the frames Fm+4 to Fm+1 to be subjected to the transfer in the next transfer operation, and updates the numbers of steps MPm+4 to MPm+1, which correspond to the frames Fm+4 to Fm+1 in the stored number-of-revolution information.

FIG. 22 is a flowchart for describing an implementation procedure example of the above-mentioned speed adjustment method. This example shows a procedure in the case of forming the intermediate images P on the first four frames in the intermediate transfer film 21, and forming the next intermediate images after retransferring the intermediate images P.

First, the controller CTA sets to m=1 (Step 1).

The traveling speed adjuster CT2 sets the rotation speed of the motor M22 in the event of executing the transfer for the frames F1 to F4 to the rotation speeds MVF1 to MVF4, corresponding to the frames F1 to F4, respectively (Step 2).

The rotation speeds MVF1 to MVF4 are stored in advance in the memory MR, and the traveling speed adjuster CT2 reads the rotation speeds MVF1 to MVF4. The rotation speeds MVF1 to MVF4 may also be acquired by executing the cueing operation of Step 14; however, the former one is preferable from the viewpoint of shortening the printing time.

The traveling speed adjuster CT2 sets the rotation speed of the motor M22 to the rotation speed MVF4 (Step 3).

The controller CTA transfers the image Y(1) to the frame F4 by the ink of the yellow ink layer Y (Step 4).

The traveling speed adjuster CT2 changes (updates) the rotation speed of the motor M22 to the rotation speed MVF3 (Step 5).

The controller CTA transfers the image M(1) to the frame F3 by the ink of the magenta ink layer M (Step 6).

The traveling speed adjuster CT2 changes (updates) the rotation speed of the motor M22 to the rotation speed MVF2 (Step 7).

The controller CTA transfers the image C(1) to the frame F2 by the ink of the cyan ink layer C (Step 8).

The traveling speed adjuster CT2 changes (updates) the rotation speed of the motor M22 to the rotation speed MVF1 (Step 9).

The controller CTA transfers the image BK(1) to the frame F1 by the ink of the black ink layer BK (Step 10). By execution of Step 10, the intermediate image P(1) is formed on the frame F1 (Step 11).

The controller CTA changes m to m+1 (Step 12), and determines whether or not m has reached a predetermined value (Step 13). In the case where m has reached the predetermined value (Yes), the controller CTA ends the operation. In the case where m has not reached the predetermined value (No), the controller CTA executes the cueing operation.

In this cueing operation, the traveling speed adjuster CT2 grasps, as the number-of-revolution information, the numbers of steps MP2 to MP5 of the motor M22, which are required to move the intermediate transfer film 21 by the frame distance LF of each of the frame F2 to the frame F5. The traveling speed adjuster CT2 assigns the grasped numbers of steps MP2 to MP5 to Equation (1), and acquires the numbers of steps PF2 to PF5. The traveling speed adjuster CT2 assigns the acquired numbers of steps PF2 to PF5 to Equation (2), and calculates the rotation speeds MVF2 to MVF5 of the motor M22 (Step 14), and then returns the processing to Step 3.

Up to here, the description is made of the case where the motor M22 is the step motor; however, the motor M22 is not limited to the step motor, and for example, may be an AC or DC servo motor.

In such a case where the motor M22 is the AC or DC servo motor, an encoder that detects a rotation angle of a motor shaft is provided. The traveling speed adjuster CT2 grasps the rotation angle of the motor shaft, which is required to move the intermediate transfer film 21 by the frame distance LF for each frame, as the number-of-revolution information from the detection result of the encoder.

Based on the grasped rotation angle, the traveling speed adjuster CT2 sets the rotation speed of the motor, which corresponds to each frame, and changes the rotation speed of the motor so that the transfer traveling speed V of the intermediate transfer film 21 can become constant.

According to the speed adjustment method described above in detail, the transfer traveling speed V in each frame can be set as constant, irrespective of the feeding amount of the intermediate transfer film 21.

In such a way, the positional shift of the transferred intermediate image P for each frame and the color shift in each intermediate image can be prevented. Moreover, the stabilization of the colors between the intermediate images formed on the respective frames can be achieved.

What is claimed is:

1. An image forming apparatus comprising:

an ink ribbon in which a first ink layer coated with a first-color ink to an n-th ink layer coated with an n-th (n is an integer of 2 or more)-color ink are defined as a set of ink layers, and a plurality of the ink sets is repeatedly arrayed and coated along a first conveying direction;

a first transfer target in which a plurality of transfer regions are set along a second conveying direction;

a platen roller;

a thermal head configured to bring the ink ribbon and the first transfer target into pressure contact with the platen roller, and configured to transfer the inks of the ink ribbons to the first transfer target; and a controller configured to, when continuous n-spot transfer regions set on the first transfer target are named as first to n-th transfer regions in a reverse direction to an alignment sequence of the first to n-th ink layers in the ink sets, allow the thermal head to execute, for the n-spot transfer regions, transfer operations of transferring inks of first to k-th ($1 \leq k \leq n$) ink layers to k-th to first transfer regions by using first to n-th ink sets, and configured to control to form a color image, to which n-color inks are transferred on the first transfer region.

2. The image forming apparatus according to claim 1, wherein the controller is configured to allow the thermal head to execute, for second to n-th transfer regions, from $q=2$ to $q=n$ ($2 \leq q \leq n$), transfer operations of transferring inks of q-th to n-th-color ink layers to n-th to q-th transfer regions by using (n+1)-th to $\{n+(n-1)\}$-th ink sets, and configured to control to form the color image, to which the n-color inks are transferred on each of the second to n-th transfer regions.

3. The image forming apparatus according to claim 1, further comprising:

an ink ribbon conveying mechanism configured to convey the ink ribbon; and a transfer target conveying mechanism configured to convey the first transfer target, wherein the controller is configured to allow the ink ribbon conveying mechanism and the transfer target conveying mechanism to continuously convey k-spot ink layers in the ink ribbon and k-spot transfer regions in the first transfer target in a same direction, and the controller is configured to allow the thermal head to execute transfer operations of continuously transferring the inks of the first to k-th ink layers to the k-th to first transfer regions.

4. The image forming apparatus according to claim 3, wherein the controller is configured to allow the ink ribbon conveying mechanism and the transfer target conveying mechanism to continuously convey n-spot ink layers in the ink ribbon and n-spot transfer regions in the first transfer target in the same direction, and the controller is configured to allow the thermal head to execute transfer operations of continuously transferring first to-n-th ink layers in the n-spot ink layers to the first to n-th transfer regions in the first transfer target, respectively for (n+1) and after transfer regions next to the first n-spot transfer regions.

5. The image forming apparatus according to claim 3, wherein the first transfer target is a film wound around a reel, the transfer target conveying mechanism includes motor configured to rotationally drive the reel, and the controller includes a traveling speed adjuster configured to adjust a rotation speed of the motor so that a traveling speed of the film fed from the reel with respect to the thermal head becomes constant.

6. The image forming apparatus according to claim 5, wherein the traveling speed adjuster is configured to update the rotation speed of the motor for each transfer to each of the k-spot transfer regions.

7. The image forming apparatus according to claim 6, wherein the controller is configured to execute a cueing operation of moving the first transfer target so that at least one of the transfer regions passes through the thermal head in the transfer operations, and the traveling speed adjuster is configured to set the updated rotation speed based on number-of-revolution information of the motor, which is required to pass the transfer target through the transfer region in the cueing operation.

8. The image forming apparatus according to claim 1, wherein, in an event of defining the n-th transfer region in the continuous n-spot transfer regions as a final transfer region, the controller is configured to allow the thermal head to execute, from $r=1$ ($1 \leq r \leq n$) to $r=n$, transfer operations of transferring inks of ink layers of r-th to n-th colors in an r-th ink set to n-th to r-th transfer regions in the n-spot transfer regions, and configured to control to form a final color image, to which the n-color inks are transferred, on the n-th transfer region.

9. The image forming apparatus according to claim 8, wherein, in an event of making the control to form the final color image while defining the n-th transfer region as the final transfer region, the controller is configured to control to use inks of ink layers, which are determined to be used, in transfer operations for transfer regions of other sets, the transfer operations being executed later.

10. The image forming apparatus according to claim 1, wherein the first transfer target includes marks given to respective boundary regions between the n-spot transfer region, the image forming apparatus further includes a sensor configured to detect the marks and output mark detection information, and the controller is configured to control timing of sending out image data to the thermal head based on the mark detection information.

11. A retransfer printer comprising:

the image forming apparatus according to claim 1; and a retransfer apparatus configured to retransfer a color image formed on the first transfer target to a second transfer target.

12. An image forming method comprising:

superimposing an ink ribbon and a transfer target on each other, wherein, in the ink ribbon, a first ink layer coated with a first-color ink to an n-th ink layer coated with an n-th (n is an integer of 2 or more)-color ink are defined as a set of ink layers, and a plurality of the ink sets is repeatedly arrayed and coated along a first conveying direction, and in the transfer target, a plurality of transfer regions are set along a second conveying direction;

when continuous n-spot transfer regions set on the transfer target are named as first to n-th transfer regions in a reverse direction to an alignment sequence of the first to n-th ink layers in the ink sets, executing transfer operations of transferring inks of first to k-th ($1 \leq k \leq n$) ink layers to the n-spot transfer regions by using the 1st to n-th ink sets from k=1 to k=n; and forming a color image, to which n-color inks are transferred, on the first transfer region.

* * * * *